US006416175B2

(12) United States Patent
Furukawa et al.

(10) Patent No.: US 6,416,175 B2
(45) Date of Patent: Jul. 9, 2002

(54) COMPUTER-TO-CYLINDER TYPE LITHOGRAPHIC PRINTING METHOD AND APPARATUS

(75) Inventors: Koji Furukawa; Sadao Ohsawa, both of Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/779,555

(22) Filed: Feb. 9, 2001

(30) Foreign Application Priority Data

Feb. 10, 2000 (JP) ..... 2000-033560
Feb. 17, 2000 (JP) ..... 2000-039695

(51) Int. Cl.[7] ..... B41J 2/01
(52) U.S. Cl. ..... 347/103
(58) Field of Search ..... 347/103, 120, 347/123, 111, 159, 141, 151, 55, 127, 128, 17, 154, 20, 61; 399/271, 290, 292, 293, 294, 33, 67, 320

(56) References Cited

FOREIGN PATENT DOCUMENTS

EP 0 503 621 A1 9/1992
EP 0 776 763 A1 6/1997

OTHER PUBLICATIONS

JP 56105960 (Abstract).
British Search Report dated Jun. 26, 2001.

*Primary Examiner*—Raquel Gordon
(74) *Attorney, Agent, or Firm*—Sughrue Mion, PLLC

(57) ABSTRACT

A method of computer-to-cylinder type lithographic printing comprising: loading a plate material on a plate cylinder of a printing apparatus; forming an image, based on image data signal, directly onto the plate material by an inkjet image-recording process comprising ejecting an oil-based ink from a recording head; heat-fixing the thus formed inkjet image to prepare a printing plate; and performing lithographic printing with the thus prepared printing plate, wherein said heat fixing step comprises heating with a heat roller. In a preferred embodiment, said heat-fixing step further comprises preliminary heating prior to said heating with the heat roller. Also disclosed are computer-to-cylinder type lithographic printing apparatuses for carrying out the printing methods.

13 Claims, 11 Drawing Sheets

COMPUTER-TO-CYLINDER TYPE LITHOGRAPHIC PRINTING METHOD AND APPARATUS

FIELD OF THE INVENTION

This invention relates to a lithographic printing method based on digital plate making performed on a computer-to-cylinder type printing apparatus, and more specifically, to the method of plate making and printing which is based on the use of an oil-based inkjet ink, achieving an excellent plate image quality as well as an excellent print quality. This invention also relates to a computer-to-cylinder type printing apparatus carrying out such procedures.

RELATED ART OF THE INVENTION

In the conventional lithographic printing, an ink-receptive area and an ink-repulsive area are formed on the surface of a printing plate, and printing ink is fed on the plate so as to selectively adhere to the ink-receptive area. The adhering printing ink is then transferred to paper. Usually, a hydrophilic area and oleophilic (ink-receptive) area are formed on the surface of a printing plate. Then, the hydrophilic area is wetted with fountain solution to repel printing ink.

An image formation (plate making) on a printing plate precursor (plate stock) is carried out, as the most popular method, by first outputting an original image on a silver halide photographic film with an analog or digital method, through which film a photosensitive diazo resin or photopolymer-based layer is exposed to light, and then by removing non-image areas of such a photosensitive layer with an alkaline developer.

Recently, with the advance of digital image formation technology and with the demand for making printing process efficient, a variety of proposals on systems is being made which can directly outputs images on printing plate using digital image information. Such methods are often called CTP (Computer-to-plate), or DDPP (Digital Direct Printing Plate). Image forming methods suitable for CTP include those using systems based on laser exposure in light or heat mode. Some of such systems are already in practical use.

However, such plate making methods based on laser exposure suffer from an environmental drawback caused by the use of alkaline developer needed to remove background areas of the plate material after image exposure. This drawback is common to the light and heat modes.

Still other plate making methods based on laser exposure are known, which, however, require expensive and bulky apparatus. Hence, systems based on inkjet imaging are attracting attention as inkjet recording uses an inexpensive and compact image-recording apparatus.

JP-A-64-27953 (The term "JP-A" as used herein means an "unexamined published Japanese patent application") discloses a plate making method comprising image formation with inkjet recording using an oleophilic wax ink onto a hydrophilic plate material. In the method, the plate material is used only once, but the ink ejection is consistent and thus capable of making high quality plates stably.

Further, JP-A-11-70632 discloses a plate making method based on image formation with inkjet recording using an aqueous solution or colloidal dispersion of a water-repellent organic acid salt on a hydrophilic plate material.

In the methods cited above, the printing plate must be manually loaded on the plate cylinder of a lithographic printing apparatus, thus one requires a relatively long time for plate loading, and, in the case of multi-color printing, registration error tends to occur.

Further, inkjet imaging systems are proposed which perform plate making on the printing apparatus for higher operation efficiency.

JP-A-4-97848 discloses such an on-cylinder image-recording system in which a plate drum having a hydrophilic or an oleophilic surface is used instead of the conventional plate cylinder, and in which an oleophilic or a hydrophilic image is formed with inkjet recording. The image is then used for printing, and removed or erased after printing. However, this method is disadvantageous in that the desired removability of the image (i.e., cleanability) and press life cannot be accomplished at the same time.

The inkjet image thus formed is thermally fixed. Thermal fixing has a serious effect on the press life. The conventional fixing methods based on heat emission and radiative heating with a lamp heater or a ceramic heater needed a relatively long heating time such as, for example, 20 sec at 100° C. in order to impart a sufficient press life.

In contrast, when a heat roller is used for the present purpose, the image is not only heated by the roller, but also pushed into the surface structure of the plate by the pressure of the roller. It has been confirmed that a sufficient press life is achieved with a heating condition of 80° C. for 1 sec.

However, still the temperature of the heat roller must be raised to 150° C. or more to achieve such a heating condition. Then, the thermal resistance of the roller material mainly made of rubber is not enough, and the monomer or additives of the rubbery material tend to bleed under such a high temperature. Printing plates fixed with a roller in such a condition sometimes exhibited inferior plate characteristics.

SUMMARY OF THE INVENTION

The invention has been made paying attention to the above-described objects.

An object of the present invention is to provide a computer-to-cylinder type lithographic printing method and apparatus free of development processing and suitable for digital plate making.

Another object of the present invention is to provide a lithographic printing method and apparatus which can produce a large number of prints having crisp and sharp images by in a simple manner with inexpensive equipments.

A still other object of the present invention is to provide a heat-fixing member that can achieve satisfactory press life with a short-time heating, thus increasing the fixing speed and saving the space needed for fixing step.

A further still other object of the present invention is to provide a lithographic printing method and apparatus that can achieve satisfactory press life with a short-time heating without causing any bleed, thus providing printed matters of high image quality.

Other objects and effects of the invention will become apparent from the following description.

The above-described objects of the present invention have been achieved by providing the following computer-to-cylinder type lithographic printing methods and apparatuses.

(1) A method of computer-to-cylinder type lithographic printing comprising:
  - loading a plate material on a plate cylinder of a printing apparatus;
  - forming an image, based on image data signal, directly onto the plate material by an inkjet image-recording process comprising ejecting an oil-based ink from a recording head;

heat-fixing the thus formed inkjet image to prepare a printing plate; and performing lithographic printing with the thus prepared printing plate, wherein said heat fixing step comprises heating with a heat roller.

(2) The method of computer-to-cylinder type lithographic printing according to item (1) above, wherein said heat-fixing step further comprises preliminary heating prior to said heating with the heat roller.

(3) The method of computer-to-cylinder type lithographic printing according to item (1) or (2) above, further comprising at least one of:

removing dust present on a surface of the plate material either or both prior to and during said inkjet image formation; and cleaning the recording head at least after the completion of said printing plate preparation.

(4) A computer-to-cylinder type lithographic printing apparatus comprising:

an image-forming unit comprising an inkjet recording device which has a recording head and which forms an image directly onto a plate material loaded on a plate cylinder by ejecting an oil-based ink from the recording head based on image data signal;

heat-fixing unit which fixes the formed image to prepare a printing plate; and lithographic printing unit which carries out lithographic printing with the thus prepared printing plate having the heat-fixed image, wherein said heat fixing unit comprises a heat roller.

(5) The computer-to-cylinder type lithographic printing apparatus according to item (4) above, wherein said heat fixing unit further comprises a preliminary heating member disposed at an upstream portion of said heat roller.

(6) The computer-to-cylinder type lithographic printing apparatus according to item (4) or (5) above, further comprising a distancing/approximating member capable of distancing and approximating said heat-fixing unit with respect to the plate cylinder so that said heat-fixing unit is distant from the plate cylinder except during the fixing.

(7) The computer-to-cylinder type lithographic printing apparatus according to any one of items (4) to (6) above, wherein said image forming unit further comprises a dust removing member which removes dust present on a surface of the plate surface either or both prior to and during the image formation.

(8) The computer-to-cylinder type lithographic printing apparatus according to any one of items (4) to (7) above, wherein the plate cylinder is rotatable to carry out main scanning upon the image formation.

(9) The computer-to-cylinder type lithographic printing apparatus according to item (8) above, wherein said inkjet head comprises a single channel head or a multi channel head and movable in an axial direction of the plate cylinder to carry out sub-scanning upon the image information.

(10) The computer-to-cylinder type lithographic printing apparatus according to item (8) above, wherein said recording head comprises a full-line head having a width substantially equal to the width of said cylinder.

(11) The computer-to-cylinder type lithographic printing apparatus according to any one of items (4) to (10) above, wherein said image-forming unit further comprises a head distancing/approximating member capable of approximating said recording head to said cylinder upon the image formation onto the plate material and of distancing said recording head from the cylinder except during the image formation.

(12) The computer-to-cylinder type lithographic printing apparatus according to any one of items (4) to (11) above, wherein said image-forming unit further comprises a recording head-cleaning member which cleans said recording head at least after the completion of said printing plate preparation.

(13) The computer-to-cylinder type lithographic printing apparatus according to any one of items (4) to (12) above, wherein said lithographic printing unit comprises a paper dust removing member which removes paper dust generating upon the lithographic printing.

Figure 1:
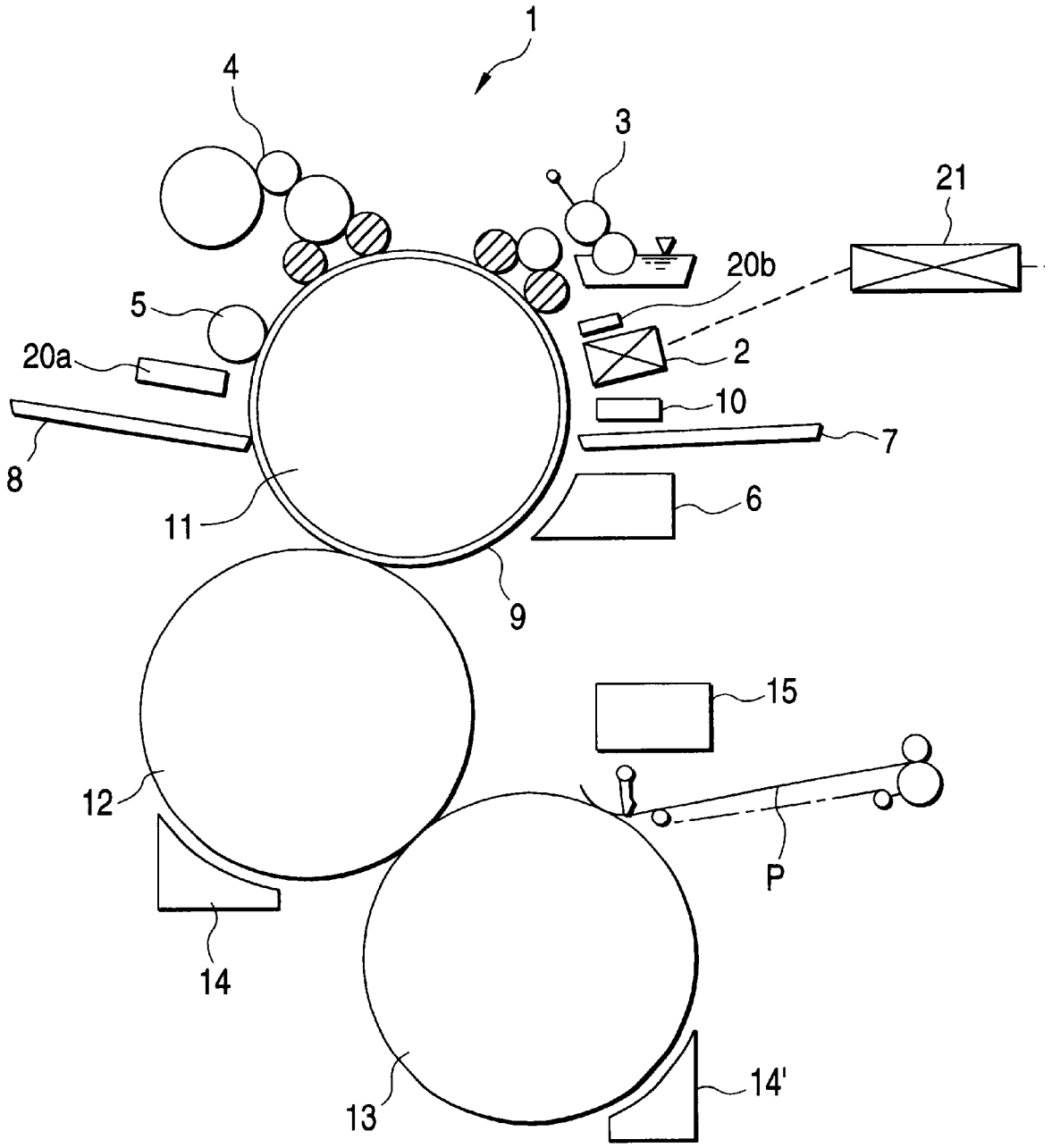
FIG. 1 schematically illustrates the entire construction of an example of the computer-to-cylinder type single-color lithographic printing apparatus according to the invention.

In the figures, the reference numerals denote the following members, respectively.

1: Computer-to-cylinder type lithographic printing apparatus
2: Inkjet recording device
3: Fountain solution-feeding unit
4: Printing ink-feeding unit
5: Fixing unit
5': Heat roller
5": Preliminary heating member
6: Plate desensitizing device
7: Automatic plate loader
8: Automatic plate unloader
9: Plate material (Raw stock)
10: Dust-removing member
11: Plate cylinder
11*a:* Heat-insulating material
12: Blanket cylinder
13: Impression cylinder
14: Blanket-cleaning unit
14': Impression cylinder-cleaning unit
15: Paper dust generation-preventing unit
20*a:* Digital control member
20*b:* Head-protecting member
21: Image data processing and controlling unit
22: Ejecting head
22*b:* Ejecting electrode
24: Ink feeding unit
25: Ink tank
26: Ink feeder
27: Agitating member
28: Ink temperature-controlling member
29: Ink concentration-controlling member
30: Encoder
31: Head distancing/approximating member
32: Head sub-scanning member
41: Head main body
42 & 42': Meniscus-regulating plate
43: Ink groove
44: Bulkhead
45 & 45': Ejecting portion
46: Bulkhead
51: Cover
52: Shutter
P: Printing paper
F: Hood

DETAILED DESCRIPTION OF THE INVENTION

In the following, detailed descriptions on embodiments for carrying out the invention are described below.

The invention comprises forming images by inkjet recording using an ink containing at least an oleophilic ingredient, and the inkjet recording applicable to the invention includes any of those capable of ejecting inks containing an oleophilic ingredient.

More concretely, various types of inkjet recording including piezo or thermal jet, electrostatic, discharge and other methods can be used. They are described in, for example, Chapter 3 of "Imaging, Part 2, The newest hardcopy printer technologies", edited by the Society of Electrophotography of Japan, and published by Shashin Kogyo Shuppansha (Photographic Industry Publisher) in 1988, and "Recording and memory technology handbook", edited by Hiroshi Kokado and published by Maruzen Publishing Co., Ltd. in 1992. Further, those disclosed in JP-A-10-175300, JP-A-6-23986, JP-A-5-131633, JP-A-10-114073, JP-A-10-34967, JP-A-3-104650 and JP-A-8-300803, can be applied. Moreover, modified and combined methods of these are also applicable to the invention.

As, according to the invention, plate making is performed on the printing apparatus by inkjet recording, a large number of high quality prints can be produced with an inexpensive apparatus and a simple method.

Some configurational examples of the computer-to-cylinder type lithographic printing apparatus used to practice the invention are described below.

Figure 2:
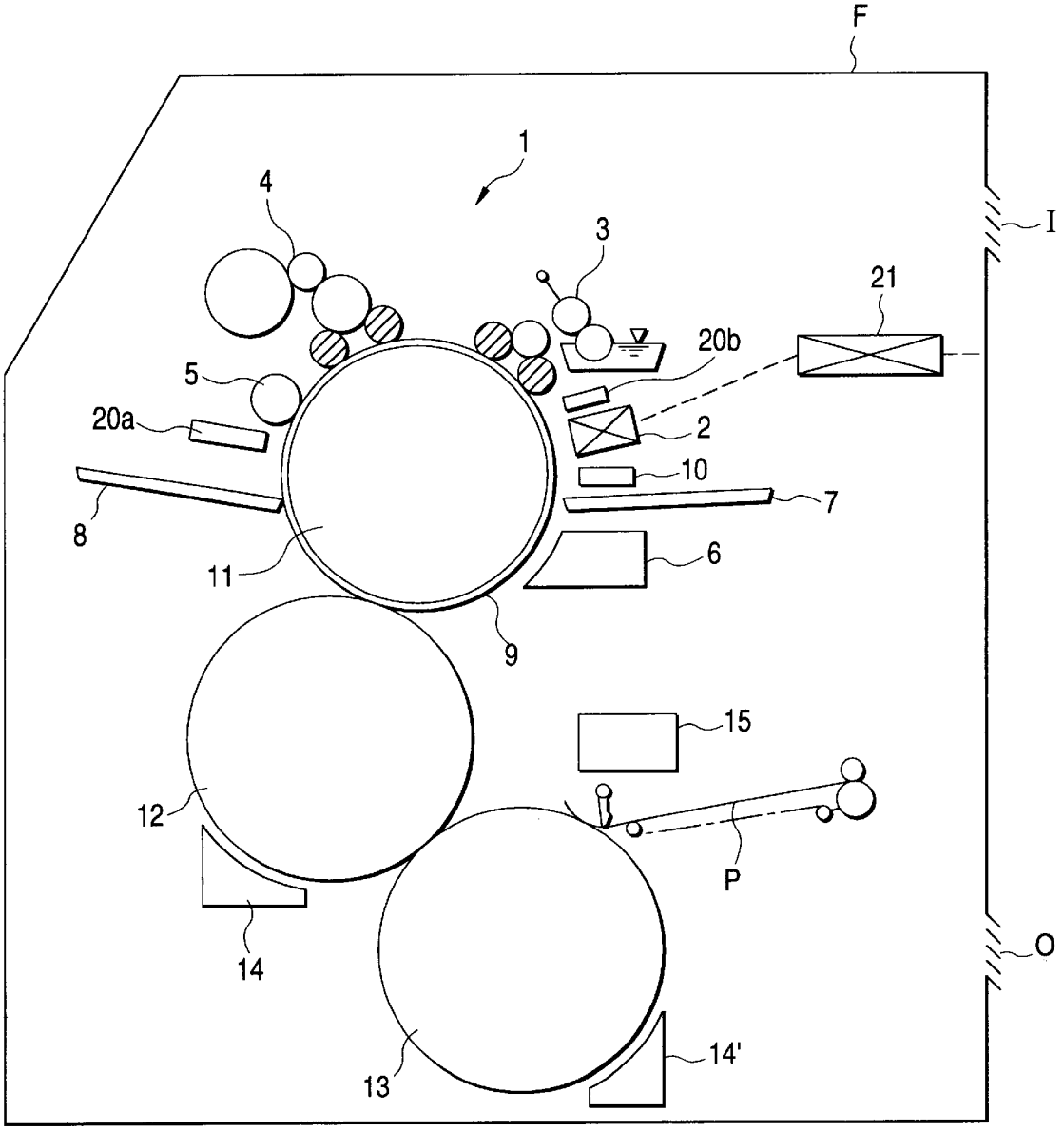
FIG. 2 schematically illustrates the entire construction of another example of the computer-to-cylinder type single-color lithographic printing apparatus according to the invention.
Figure 3:
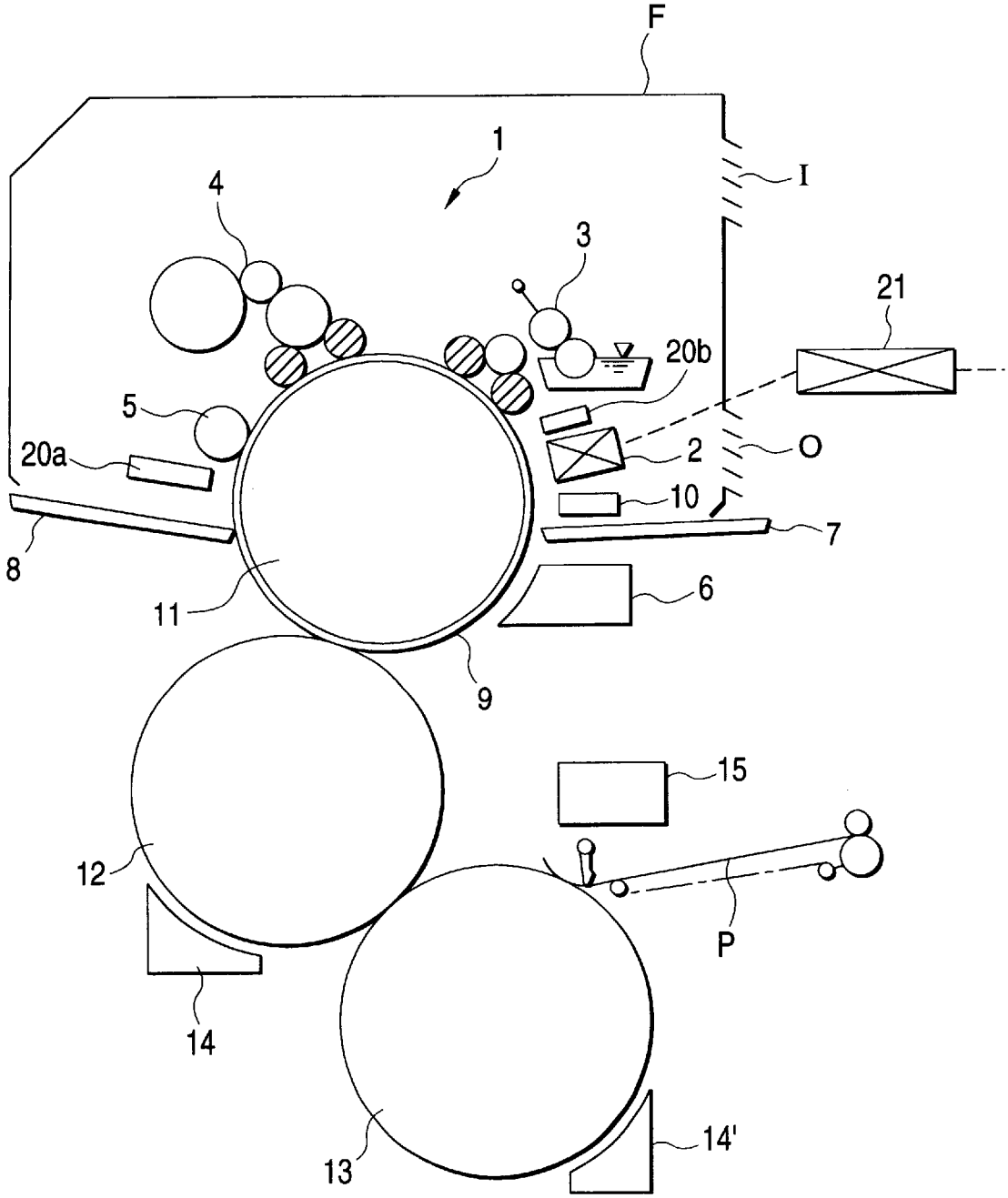
FIG. 3 schematically illustrates the entire construction of still another example of the computer-to-cylinder type single-color lithographic printing apparatus according to the invention.
Figure 4:
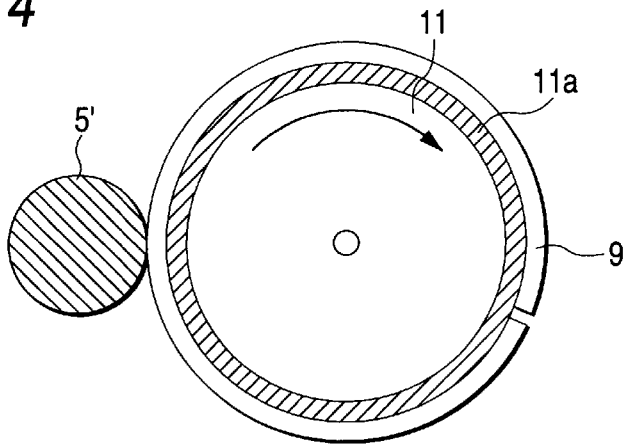
FIG. 4 illustrates a positional relationship between the heat roller used as the image-fixing unit of the invention and the plate cylinder.

FIG. 1 to FIG. 3 each shows the entire configuration of single-color single-sided computer-to-cylinder type lithographic printing apparatuses according to the invention, and FIG. 4 illustrates the spatial arrangement of the plate cylinder and the heat roller as an example of fixing unit 5 shown in FIG. 1 to FIG. 3.

Figure 5:
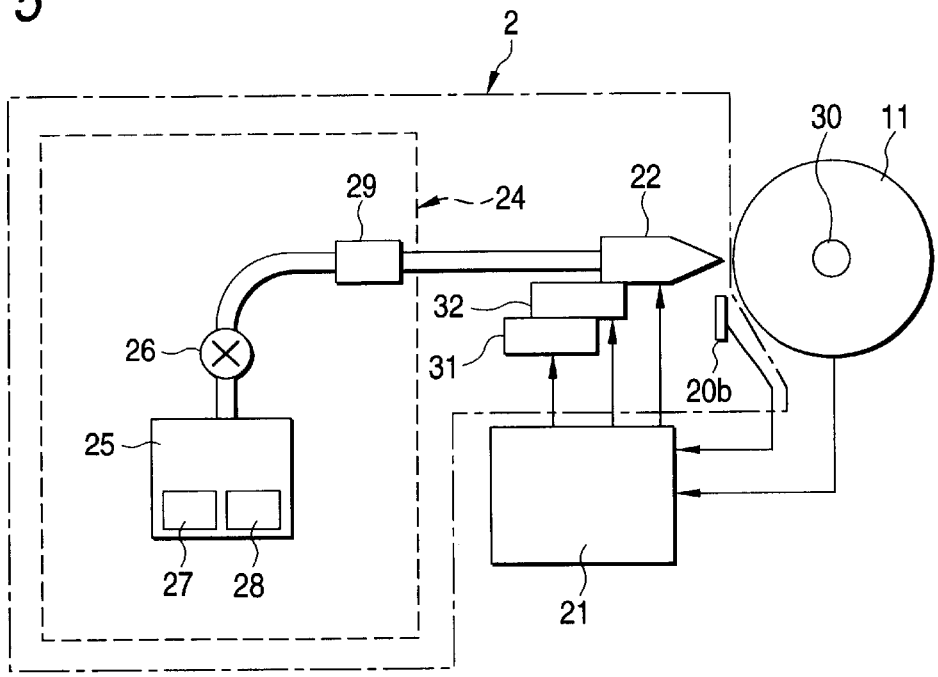
FIG. 5 schematically illustrates an example of the image-recording part for use in the apparatuses depicted in FIG. 1 to FIG. 3.

FIG. 5 shows a schematic structure of the image-recording part of the apparatuses shown in FIG. 1 to FIG. 3, including a controlling unit, an ink supply unit and a head distancing/approximating member.

Figure 6:
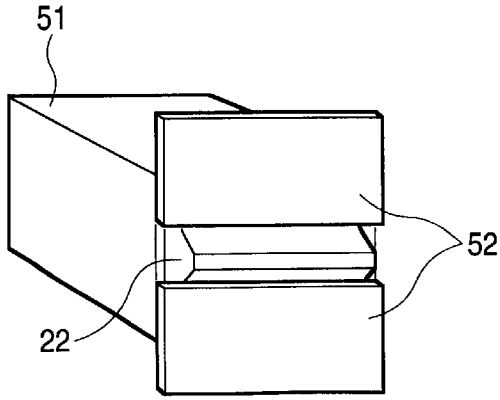
FIG. 6 schematically illustrates an embodiment of a head-protecting cover for use in the invention.

FIG. 6 shows a head-protecting cover as an example of the head-protecting cover for use in the invention.

Figure 7:
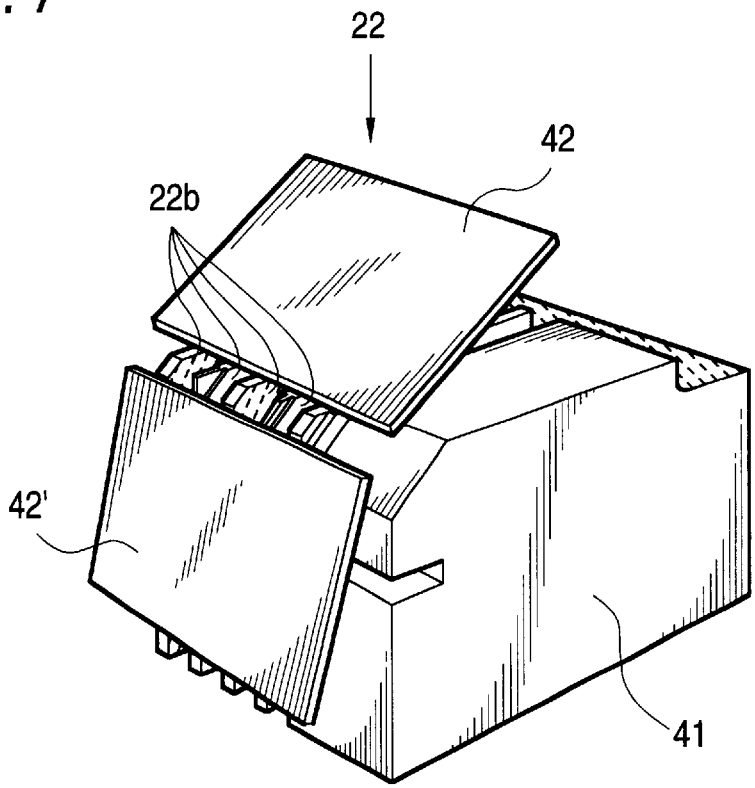
FIG. 7 schematically illustrates main portions of the inkjet recording device for use in the invention.
Figure 8:
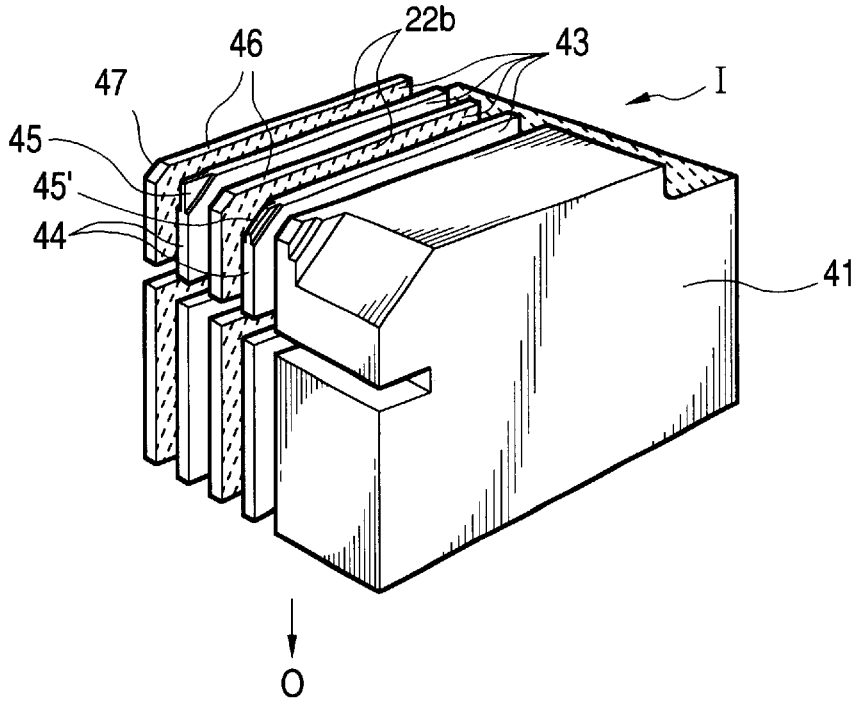
FIG. 8 schematically illustrates the inkjet recording device depicted in FIG. 7 from which meniscus-regulating plates have been removed.
Figure 9:
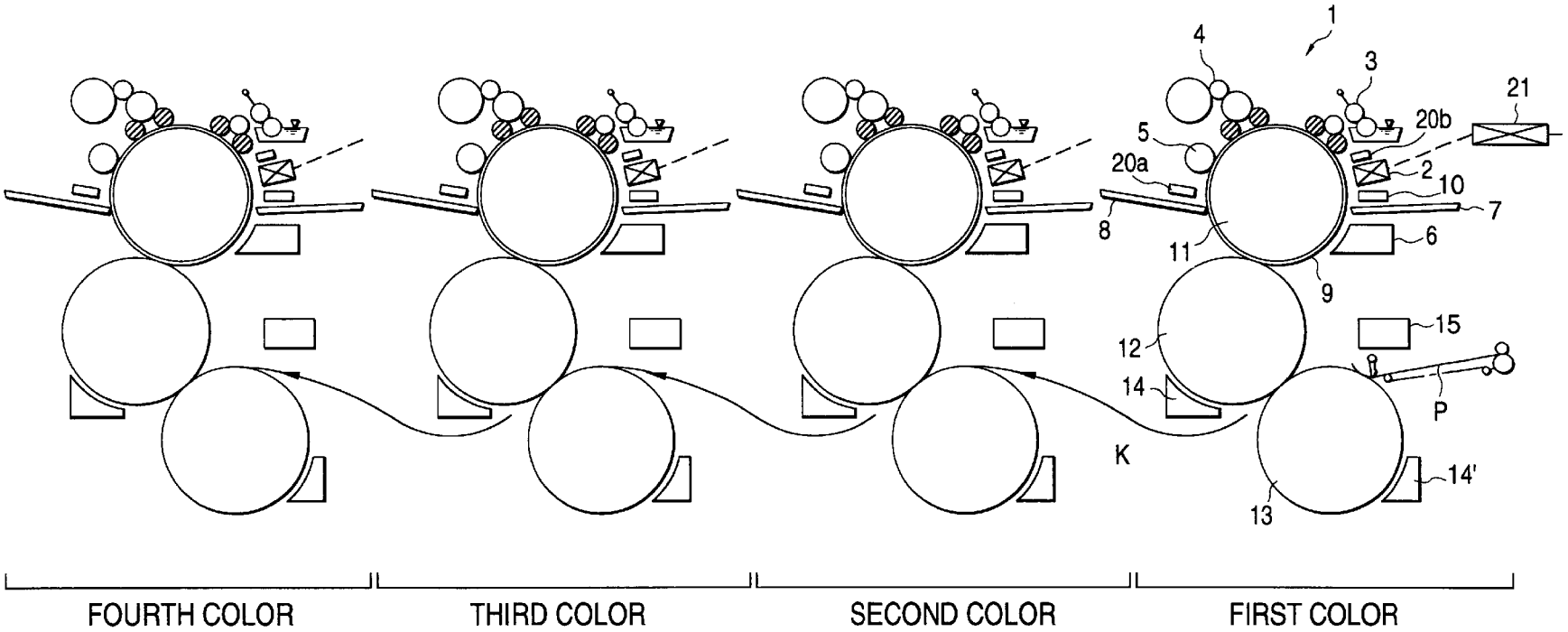
FIG. 9 schematically illustrates a computer-to-cylinder type four-color single-sided lithographic printing apparatus as an example of the multi-color printing apparatus according to the invention.

FIG. 7 and FIG. 8 each shows an example of the inkjet recording device to be installed in the computer-to-cylinder type lithographic printing apparatuses depicted in FIG. 1 and FIG. 9.

FIG. 9 shows the entire construction of a four-color single-sided computer-to-cylinder type lithographic printing apparatus according to the invention.

Figure 10:
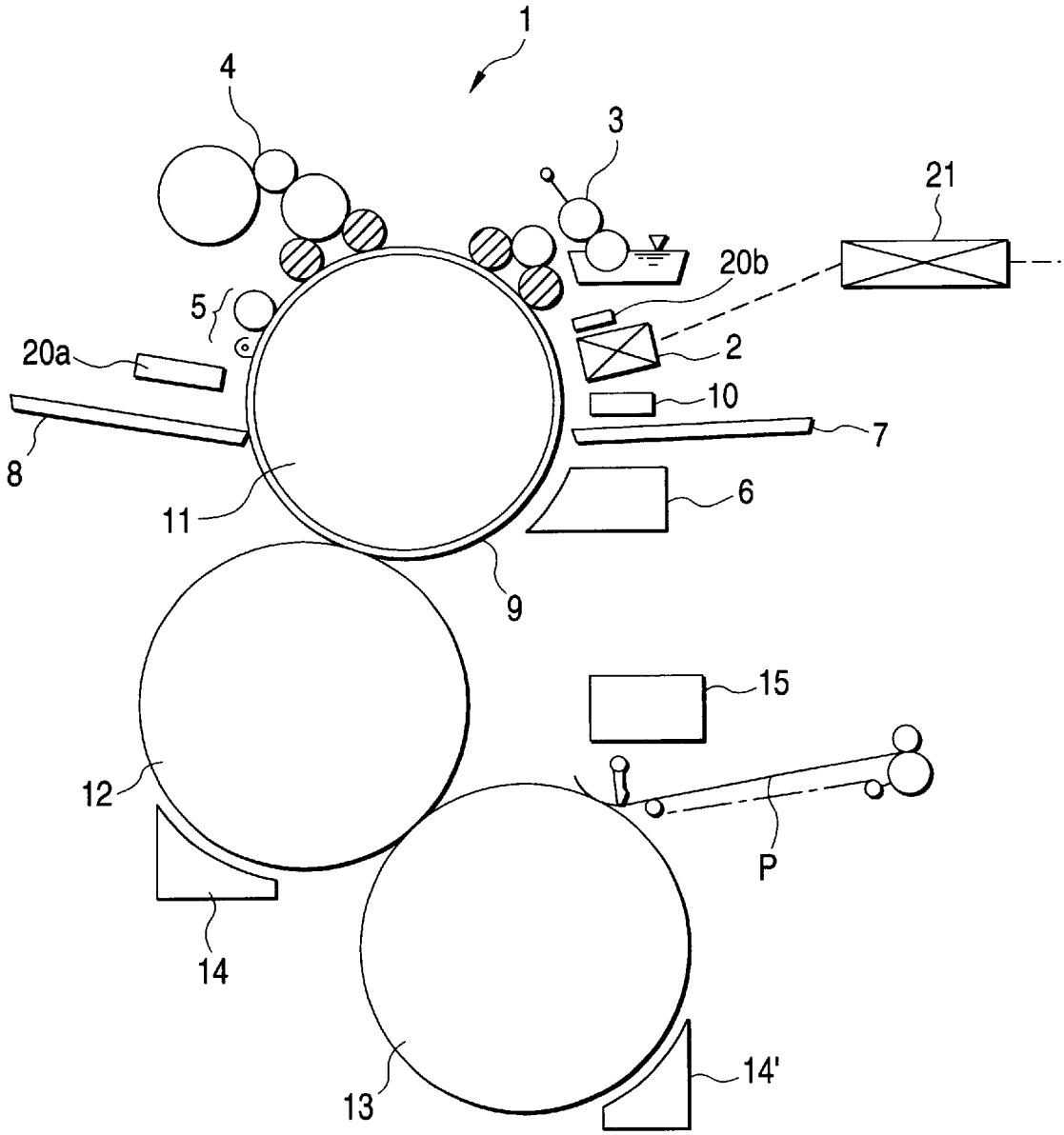
FIG. 10 schematically illustrates the entire construction of an example of the computer-to-cylinder type single-color lithographic printing apparatus according to a preferred embodiment of the invention.
Figure 11:
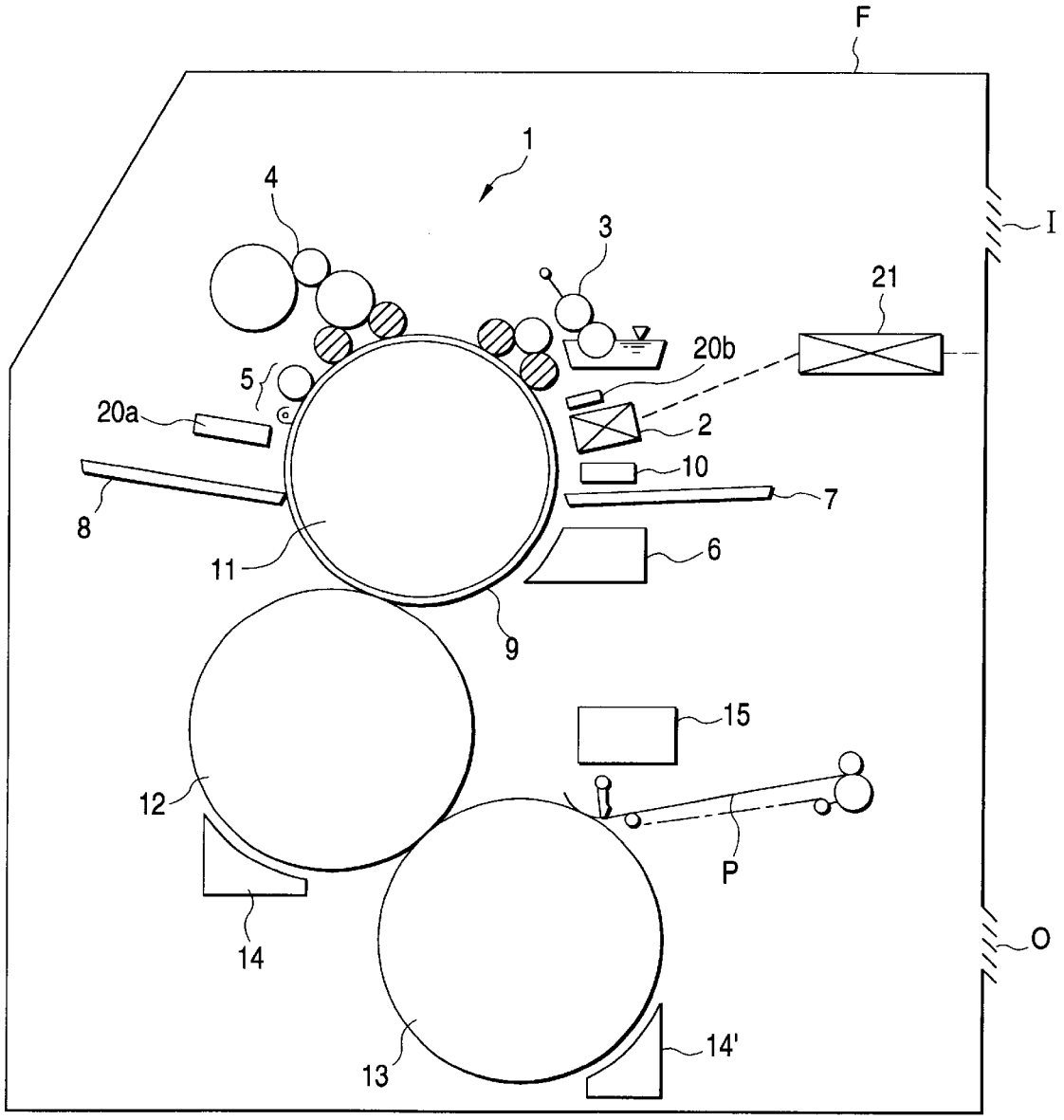
FIG. 11 schematically illustrates the entire construction of another example of the computer-to-cylinder type single-color lithographic printing apparatus according to a preferred embodiment of the invention.
Figure 12:
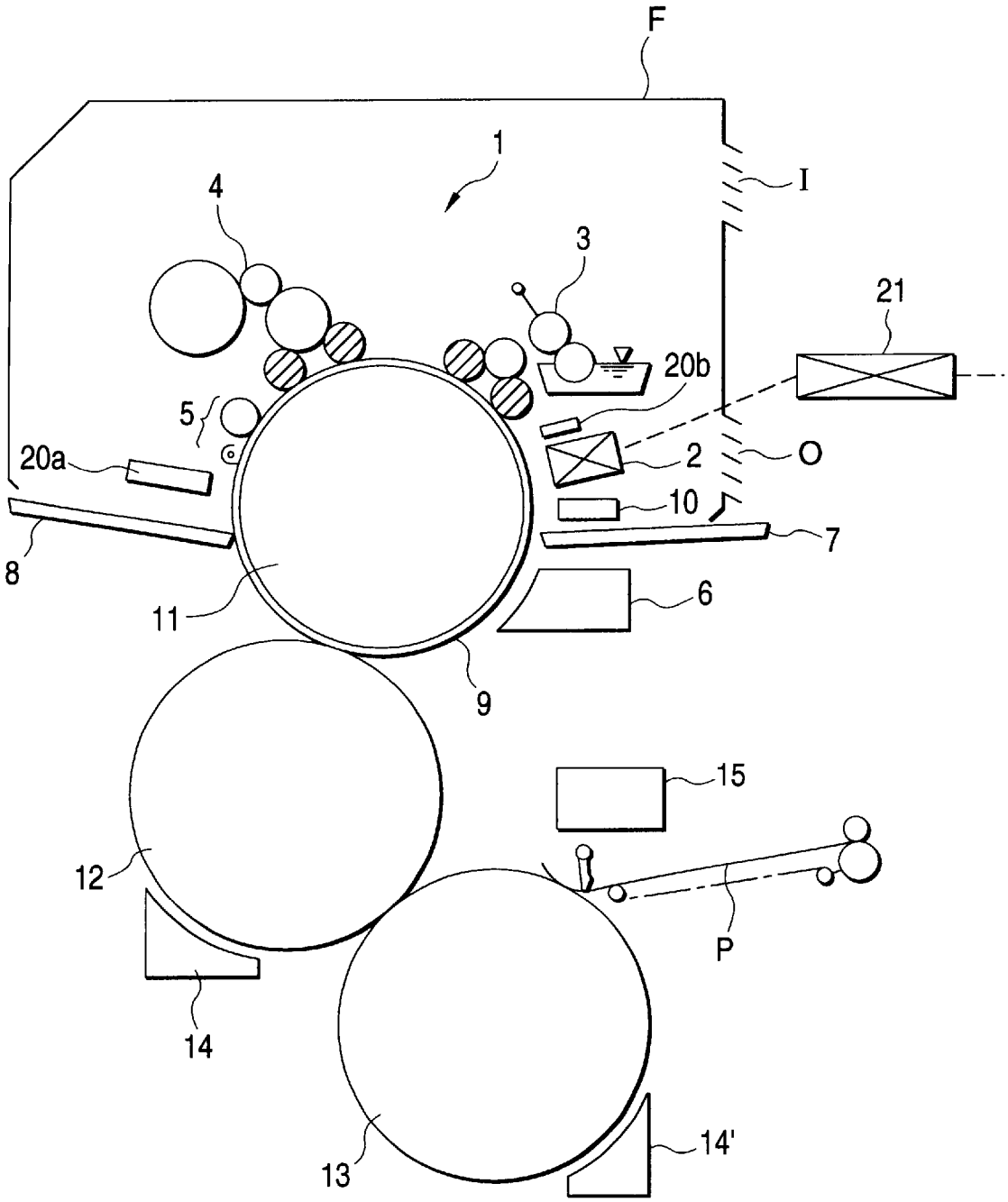
FIG. 12 schematically illustrates the entire construction of still another example of the computer-to-cylinder type single-color lithographic printing apparatus according to a preferred embodiment of the invention.
Figure 13:
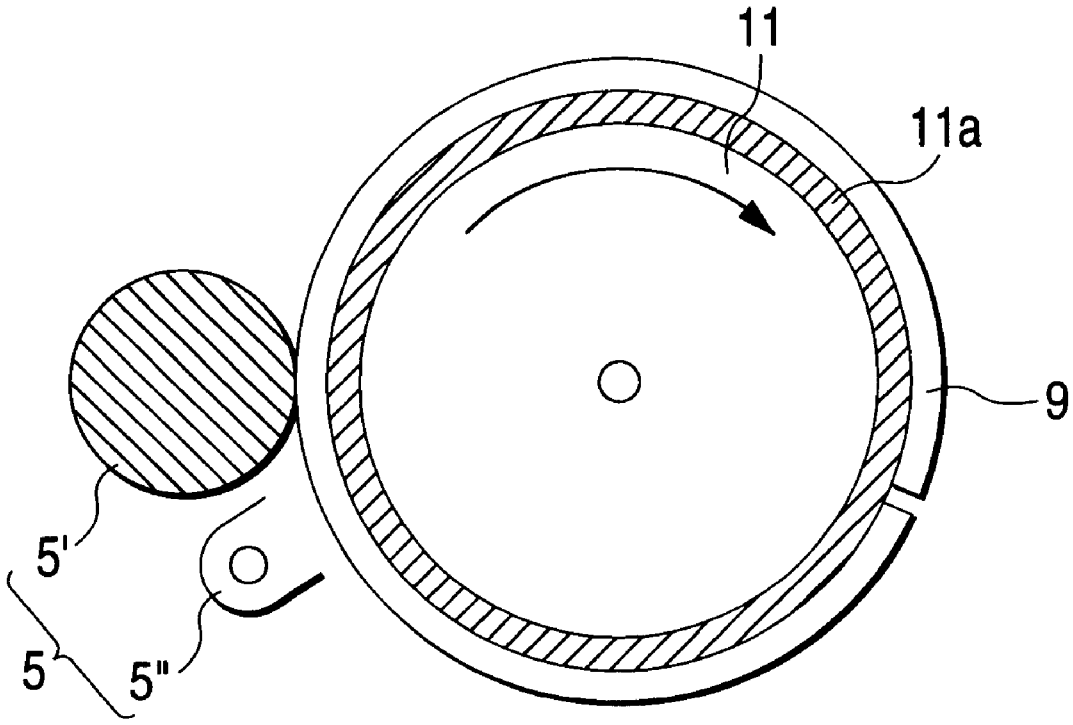
FIG. 13 illustrates a positional relationship between the heat roller and preliminary heating member used in the image-fixing unit in a preferred embodiment of the invention and the plate cylinder.

FIG. 10 to FIG. 12 each shows the entire construction of a single-color single-sided computer-to-cylinder type lithographic printing apparatus according to a preferred embodiment of the invention, in which fixing unit 5 comprises a heat roller and a preliminary heating member. FIG. 13 illustrates the spatial arrangement of the plate cylinder and the heat roller and preliminary heating member as one embodiment of fixing unit 5 shown in FIG. 10 to FIG. 12.

Figure 14:
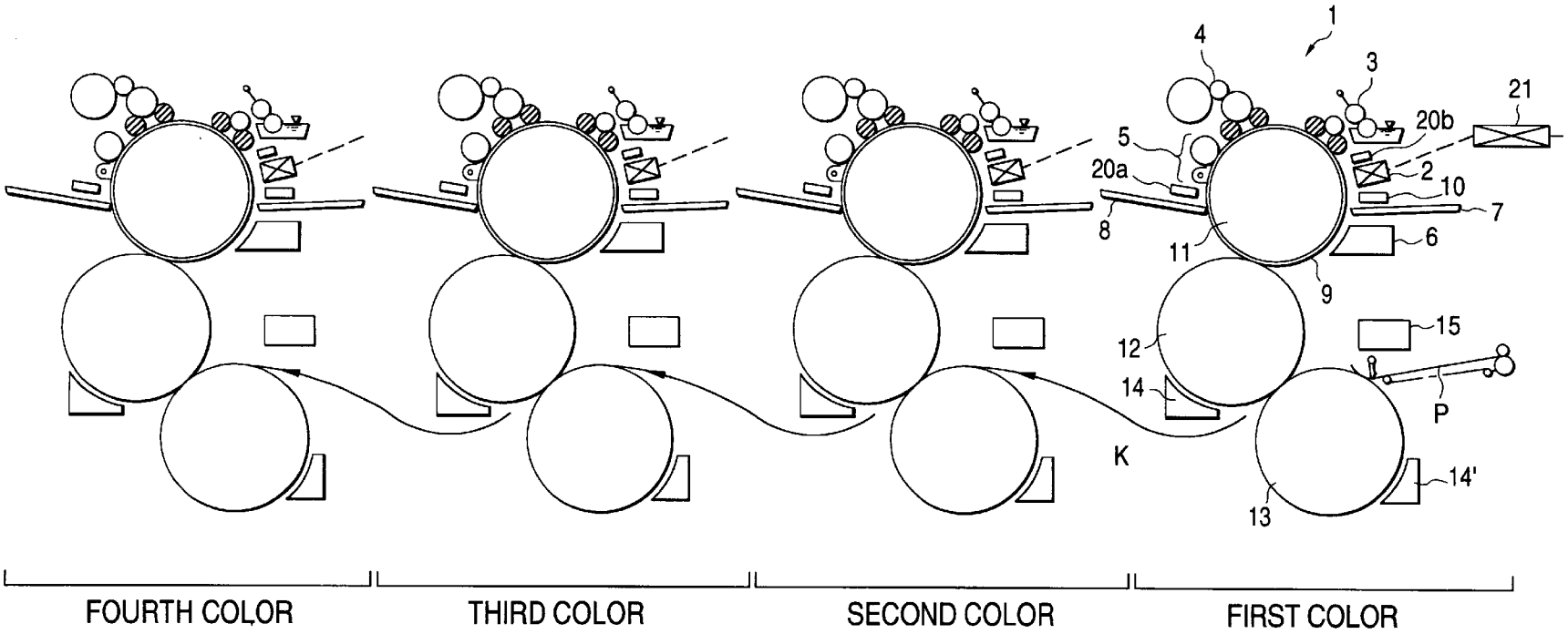
FIG. 14 schematically illustrates a computer-to-cylinder type four-color single-sided lithographic printing apparatus as an example of the multi-color printer according to a preferred embodiment of the invention.

FIG. 14 shows the entire construction of a four-color single-sided computer-to-cylinder type lithographic printing apparatus according to a preferred embodiment of the invention, in which fixing unit 5 comprises a heat roller and a preliminary heating member.

With reference to FIG. 1 that shows the entire construction of a single-color single-sided computer-to-cylinder type lithographic printing apparatus, the printing procedure of the invention will be explained.

As is shown in FIG. 1, the computer-to-cylinder type lithographic printing apparatus (hereinafter, also referred to as "printing apparatus") comprises one plate cylinder 11 one blanket cylinder 12 and one impression cylinder 13. At least while lithographic printing is carried out, blanket cylinder 12 that transfers images is in a pressed contact with plate cylinder 11 and impression cylinder 13 is pressed to blanket cylinder 12 so that the image once transferred onto blanket cylinder 12 be again transferred to printing paper P.

FIG. 2 shows another construction of such a printing apparatus based on the invention in which the printing apparatus is entirely covered with hood F. Hood F has intake hole I and exhaust hole O, both of which are equipped with dust-preventing filters not shown in the figure. It is desirable to provide a fun, etc. to cause air ventilation.

The printing apparatus can be further provided inside the hood with a solvent vapor-removing unit not to allow the solvent vapor used in the inkjet ink to be described later to leak from the printing apparatus. With such a construction, a very user- and environment-friendly printing apparatus results free from odor problems. As the hood may enclose the printing apparatus only partially, the scope of the invention is not limited to printing apparatuses with a hood entirely covering them.

Plate cylinder 11 is usually made of metal, and its surface may be plated with chromium for a better durability, or covered with heat-insulating material 11*a* as shown in FIG. 4. On adiabatic cover 11*a* is loaded plate material 9 on which an image is formed.

In the case where an electrostatic inkjet system is used, plate cylinder 11 is desirably grounded as it acts as the counter electrode of the ejecting head. Further, when the base material of the plate is highly electrically insulating, an electrically conductive layer may be provided on the base with which the plate cylinder is connected to have the common ground potential. For that purpose, any of well-known means including a brush, a board spring and a roller made of conductive material may be used.

Further, printing apparatus 1 has inkjet recording device 2, which ejects an ink containing an oleophilic ingredient onto plate material 9 loaded on plate cylinder 11 in response to the image data sent from image data processing and controlling unit 21.

Printing apparatus 1 has an image-fixing unit to strengthen the inkjet image formed on plate material 9. In the present invention, the image-fixing unit comprises a heat roller 5' as shown in FIG. 4. The fixing unit will be described in more detail below.

Printing apparatus 1 also has unit 3 that supplies fountain solution to the hydrophilic (non-image) areas of plate 9. FIG. 1 depicts a Morton water feed type as a typical fountain solution-feeding unit, but other types for the same purpose known in the art can be used such as SHINFLO water feed type or continuous water feed type.

Printing apparatus 1 has also a printing ink feeding unit 4. If needed, desensitization unit 6 may also be equipped that improves the hydrophilic nature of the plate surface.

Printing apparatus 1 has furthermore dust-removing member 10 that removes dust present on the plate material surface prior to or during recording. Dust removal can be achieved by any method known in the art including non-contact ones such as blow-off or electrostatic removing, and contact ones using a brush or a roller. Among them, the most preferable methods are air suction or blowing. These methods can be applied separately or in combination. In any case, the pump equipped in the printing apparatus for printing paper feed may be diverted for the dust removal.

Printing apparatus 1 may further have automatic plate material loader 7 that automatically loads plate material 9 onto plate cylinder 11 automatic plate unloader 8 that removes plate 9 from plate cylinder 11 after printing operation has finished. Commercially available printers equipped with these auxiliary units well known in the art include, for example, Hamada VS34A and B452A, products of Hamada Printing Machinery Co., Ltd., Toko 8000PFA of Tokyo Koku Keiki Co., Ltd., Ryobi 3200ACD and 3200PFA, products of Ryobi Imagix Co., Ltd., AMSIS Multi 5150FA of AM Japan Co., Ltd, Oliver 266EPZ of Sakurai Graphic Systems Co., Ltd., and Shinohara 66IV/IVP sold by Shinohara Trading Co., Ltd. Still other optional units include blanket-cleaning unit 14 and impression cylinder-cleaning unit 14'. The advantageous features of the invention can be enhanced with the use of automatic plate loader 7, automatic plate unloader 8 and two washing units 14 and 14' because the printing operations become easy and the turnaround time is shortened. It is also desirable to install paper dust generation-preventing unit 15 close to plate cylinder 13 to prevent paper dust from depositing on the plate material. Paper dust prevention can be performed by humidity control, dust suction with air or with electrostatic force.

Image data processing and controlling unit 21 receives image data from image scanners, magnetic disc devices or image data transmission devices, carries out color separation, and further digitizes and quantizes the color-separated data. Moreover, it calculates dot coverage values in order to output halftone inkjet images by using ink-ejecting head 22 (See FIG. 5, to be described below) in inkjet recording device 2.

Image data processing and controlling unit 21 further controls the movement of inkjet head 22 and the timing for its ink ejection, and, if needed, the operating timing of plate cylinder 11 blanket cylinder 12 and impression cylinder 13.

With reference to FIGS. 1 to 3, and also partially to FIG. 5, the plate making procedure carried out by printing apparatus 1 is described in detail below.

First, plate material 9 is attached to plate cylinder 11 with use of automatic plate loader 7. Such an attaching operation can be carried out by a mechanical means of grasping the leading or trailing edge of the plate material, or by an electrostatic method, both well known in the art. As the entire area of the plate material is fixed on the plate cylinder in an intimate contact with it, the trailing edge of the plate material will never flap, thus not damaging inkjet recording device 2 placed close to the plate cylinder during recording. Alternatively, a similarly desirable condition can be realized by keeping the plate material in an intimate contact with the plate cylinder only at a limited area including the recording position for the inkjet recording device. Practically, for example, plate-suppressing rollers may be arranged either at upstream and downstream sides of the recording position.

Means of fixing the trailing edge of the plate may be used in the plate attaching process. Such means comprises a roller, a guide or electrostatic attraction, which act to keep the trailing edge away from the ink-feeding roller, thus preventing the plate surface from smudging and also reducing paper loss.

Image data from, for example, magnetic disk devices, are sent to image data processing and controlling unit 21, which calculates ink ejecting positions and the area coverage at each position based on the input image data. These calculated data are once stored in a buffer memory. Image data processing and controlling unit 21 rotates plate cylinder 11 as in FIG. 5, and moves inkjet head 22 using head distancing/approximating unit 31 to a recording position close to plate cylinder 11. The gap between the head 22 and the surface of plate material 9 loaded on plate cylinder 11 is kept at a pre-determined value during recording by mechanical control using a spacing roller, or by controlling the head distancing/approximating unit with the signal from an optical gap detector. Inkjet head 22 may comprises a single-channel head, multi-channel head, or a full line head. Main scanning is carried out by a rotation of plate cylinder 11.

In cases where the head is of a multi-channel or full line type having plural ejecting portions, those ejecting portions are arranged along the axial direction of the plate cylinder.

In the case of a single-channel or multi-channel head, head 22 is moved along the plate cylinder axis for every 360-degree rotation of the plate cylinder by image data processing and controlling unit 21, and the ink is ejected onto plate material 9 loaded on plate cylinder 11 by the amounts corresponding to the calculated area coverage value for each calculated position. In this manner, a halftone image comprising the inkjet ink and reproducing the density distribution of the original is formed on plate material 9. Such an operation continues until an ink image corresponding to a single color for the original completes.

On the other hand, in the case of a full line head having a length substantially equal to the width of the plate cylinder, every 360-degree rotation of the plate cylinder completes the formation of a single color image for the original on plate material 9. In this case, the plate cylinder rotates to carry out main scanning whereby the positional accuracy is high with a very fast recording.

Inkjet head 22 is driven to retreat away from the recording position close to plate cylinder 11 except when the head is subjected to recording. Not only head 22, but also sub-scanning member 32 may be separated from the plate cylinder surface. Further, all of head 22, ink supplying unit 24 and sub-scanning member 32 may be moved together. When, together with these three, fixing unit 5 and dust removing unit 10 are driven for the approaching and retreating movement, too, the entire system can be used for conventional printing.

The head distancing/approximating member acts to separate the recording head at least by 500 $\mu$m from the plate cylinder surface when the head is not operating. Such a separation may be performed with a sliding structure, or with an arm fixed to a certain axis and by rotating the arm around the axis to cause a pendulum-like movement of those units. With such a head retreat in its suspended state, the inkjet head is protected from physical damage and contamination, thus enjoying a long operation life.

The mechanical durability of the inkjet image thus formed is improved by applying heat with fixing unit 5. An important feature of the invention is the adoption of heat roller as such a fixing member. The thermal fixing after image formation is significant as it governs the press life of the resulting plate image; however, conventional heating means such as lamp or ceramic heater based on thermal emission and radiative heating required a relatively long heating time of, for example, 20 sec at 100° C. to achieve a sufficient press life.

In contrast, heating with a heat roller according to the invention requires only 1 sec at 80° C. to achieve a sufficient press life, as the inkjet image is not only melted by heat but at the same time pressed into the surface structure of the plate material by the pressure applied by the heat roller.

Hence, the invention can markedly accelerate the fixing operation with a spatially compact fixing unit.

According to a preferred embodiment of the invention, image fixing unit 5 comprises heat roller 5' and preliminary heating member 5" disposed in the upstream side of heat roller 5' along the heat-fixing processing stage.

Preliminary heating member 5" includes, for example, a near infrared lamp. If preliminary heating of the plate material to about 80° C. by the preliminary heating member is carried out prior to the heat fixing with heat roller 5', the temperature of heat roller 5' can be set lower than the case of heat-fixing with heat roller 5' alone.

After the plate making described previously, the conventional lithographic printing can be performed; i.e., plate 9 holding the inkjet image containing an oleophilic ingredient is fed with a printing ink and fountain solution, and the printing ink image is first transferred onto blanket cylinder 12 rotating with plate cylinder 11 and then further from the blanket cylinder to a sheet of printing paper passing between blanket cylinder 12 and impression cylinder 13. With the end of printing, the blanket held on blanket cylinder 12 is washed with blanket-cleaning unit 14 to be made ready for next printing.

20*a* is a digital control member installed to enhance the operability of printing apparatus 1 of the invention, including, for example, an ink consumption indicator or a plate checker. The ink consumption indicator that calculates in advance the quantity of ink needed based on image data are very useful for the present printing apparatus 1 that carries out plate making continuously.

It should be noted that plate check is impossible with the present printing apparatus because the plates are made on the plate cylinder. The present plate checker is installed to cover this drawback. Concretely, a CCD camera or other sensor installed in the checker reads the image formed on the plate, and displays it on a monitor for visual inspection. By using digital image processing, the accuracy of plate check can be enhanced.

Next, inkjet recording device 2 will be explained in detail with reference to FIG. 5.

Image-recording part for use in the present printing apparatus 1 comprises inkjet ink ejecting head 22, head-protecting member 20*b* and ink feeding unit 24, as is shown in FIG. 5. Head-protecting member 20*b* includes, (1) those to prevent the deposition of foreign materials on the head, and (2) those to suspending recording in the case of anomaly.

(1) Protecting member from foreign material deposition include, for example, a head-protecting cover. FIG. 6 depicts an example of such a cover implementing the invention. In the figure, head 22 is located inside cover 51 equipped with shutter 52; image recording is carried out with shutter 52 opened and with head 22 advancing to its recording position. The space inside cover 51 may be filled with the ink or an ink solvent, and with such an enclosed structure, head 22 is protected from troubles caused by ink solidification even if the head is suspended for long time.

(2) As an example of the member of suspending recording in the case of anomaly, a dust detector or a detector of abnormal head current is connected to image data processing and controlling unit 21, which, for the detection of abnormal head current, immediately stops sending voltage signal to the head to prevent head damage.

On the other hand, ink supply unit 24 comprises ink tank 25, ink feeder 26 and ink concentration-controlling member 29. In ink tank 25, agitating member 27 and ink temperature-controlling member 28 may further be equipped.

Agitating member 27 prevents the precipitation or coagulation of the solid ingredients contained in the ink.

Ink temperature-controlling member 28 is arranged to prevent the drift of ink characteristics due to ambient temperature changes, since such a drift tends to cause the recorded dot size to fluctuate and thus the deterioration of image quality. Moreover, if high quality images are to be recorded, ink concentration-controlling member 29 is provided according to the required quality level. The concentration of ink is monitored optically, by measuring its physical properties such as electro-conductivity or viscosity, or by the number of recorded plates. In the case where physical property measurements are made, an optical detector, a conductivity sensor or a viscosity sensor is installed in the ink flow path of the ink tank alone or in combination, and the output signals from those measuring devices are used for the replenishment of an undiluted ink or an ink diluent from a corresponding reservoir, (both not shown in the figure) respectively to the ink tank. In the case of the management based on the recorded plate number, the replenishment is made according to the integrated number of recorded plates or the frequency of recording.

In addition to the calculation of input image data or the motion control of the head using head distancing/approximating unit 31 or head sub-scanning member 32, image data processing and controlling unit 21 shifts the head under the direction of the timing pulse from encoder 30 provided on plate cylinder 11 whereby the positional accuracy along the sub-scanning direction is raised.

Image data processing and controlling unit 21 further controls head-protecting member 20*b* described previously. Moreover, during inkjet recording, plate cylinder 11 may be rotated with a high precision driving member other than the one used for lithographic printing to raise the positional accuracy along the sub-scanning direction whereby plate cylinder 11 alone should desirably be rotated with blanket cylinder 12 and impression cylinder 13 mechanically separated from the plate cylinder. Concretely, the output of a high precision motor is used to move plate cylinder 11 after decelerated via a high precision gear or a steel belt. In the case where the quality level of inkjet recording must be raised, such highly precise driving member are employed solely or in combination.

Head 22 can have a maintenance device such as a cleaning member if necessary. For example, if the head is suspended for an extended period or a recorded image deteriorates, the tip of the ink-ejecting portion is swept with a flexible brush or cloth, or the ejecting portion is cleaned by the circulation of pure ink solvent together with or without suction of the head. These countermeasures may be adopted separately or in combination to maintain the head in the desirable recording condition. To prevent ink solidification, the head may be cooled, thus suppressing the vaporization of the ink solvent. When the head gets badly dirty or contaminated, the head is compulsorily subjected to suction, supplied with an intense stream of air, ink or solvent, or immersed in an ink solvent and applied ultrasonic wave. Each of these countermeasures can be adopted individually or in combination.

As another embodiment of the invention, a computer-to-cylinder type multi-color lithographic printing apparatus is explained below, the entire construction of which is illustrated in FIG. 9.

As is shown in FIG. 9, this multi-color single-sided printing apparatus basically composed of four single-color printing apparatuses shown in FIG. 1 comprising plate cylinder 11 blanket cylinder 12 and impression cylinder 13, arranged in series and in such a manner that printing is made on one side of printing paper P. The transport of the paper sheet between contiguous impression cylinders (designated only by K, but no hardware being shown in the figure) is carried out with a transfer cylinder well known in the art. As is understood with FIG. 9, most of multi-color, one-side printers comprise plural printing units comprising plate cylinder 11, blanket cylinder 12 and impression cylinder 13 arranged as described above. As, in such a so-called unit type multi-color printer, one plate corresponding to one color is formed on the plate cylinder, the printer has plural sets of a plate cylinder and a blanket cylinder equal to the number of the colors used. On the other hand, the invention can be practiced with other types of multi-color printers: one example is a printing apparatus comprising plural sets of a plate cylinder and a blanket cylinder and only one common impression cylinder having a diameter equal to the integer multiple of the plate cylinder diameter whereas another example comprises plural sets of the common impression cylinder-type structure described above in which the total number of the plate cylinders or the blanket cylinders is equal to that of colors used. Paper sheets are run between contiguous impression cylinders with a transfer cylinder well known in the art. In the case where plural plates corresponding to plural colors are formed on a plate cylinder, the number of the plate cylinders or the blanket cylinders is equal to the number of colors used divided by the number of the plate formed on one plate cylinder. For example, when two plates for two colors are formed on one plate cylinder, four-color printing is possible with two such plate cylinders combined with two blanket cylinders. In this case, the diameter of the impression cylinder is made equal to that of the plate cylinder corresponding to one color while the impression cylinder is provided with means to retain the paper sheet thereon until all the necessary color images have been printed, and the sheet moves between contiguous impression cylinders with a transport cylinder well known in the art. In the case of the four-color printer described above comprising two plate cylinders and two blanket cylinders in which two color plates are formed on each plate cylinder, one impression. cylinder rotates twice holding a paper sheet to superimpose two color images thereon. A similar procedure is repeated on the sheet that is transported to and held on the second impression cylinder to complete a four-color printing. The number of impression cylinders may be either equal to that of plate cylinders, or may be common to plural plate cylinder/blanket sets.

In the case where the invention is practiced on a computer-to-cylinder type, multi-color dual-side lithographic printer (perfecter), the simple tandem structure can be used in which at least one paper reversing member well known in the art is arranged between contiguous impression cylinders, or plural sets of the common impression cylinder type printing apparatus described above can be used also with the use of at least one paper reversing member therebetween. Further, more than one sets of plate cylinder/blanket cylinder shown in FIG. 1 are arranged in the both sides of the sheet transport path. In such cases, when each plate cylinder handles one color image, then the number of the sets of plate cylinder/blanket cylinder needed is equal to that of the colors used for the both sides of paper. On the other hand, when each cylinder handles plural color images, one can reduce the number of plate cylinder and/or impression cylinder. The number of impression cylinder can further be reduced if plural sets of plate cylinder/blanket cylinder use a common impression cylinder whereby the impression cylinder must be equipped with means to retain a printing sheet for plural printing procedures. Further descriptions will be omitted as analogous to those for one-side type printers.

Heretofore, some practical embodiments of the invention have been explained on sheet-fed type multi-color printing apparatuses. The invention can be applied to web offset printers, too. In particular, the simple tandem or the common plate cylinder type is suited. When the invention is applied to a computer-to-cylinder type multi-color web offset prerfector, the above-described simple tandem or the common plate cylinder type can be used with at least one web reversing member provided between contiguous impression cylinders, or with such an arrangement of printing units as to carry out printing on both sides of paper. The most preferred computer-to-cylinder type multi-color web offset perfecter is so called blanket-to-blanket (BB) printer in which a set of plate cylinder/blanket cylinder is used to print one color image on one side of the web that is held by another blanket cylinder located on the other side of the web and that is used to print another image of the same color on that side of the web. Plurality of such a structure are arranged in series to carry out multi-color both-side printing whereby the web runs between the two blanket cylinders in pressed relationship with each other.

As another embodiment of the printing apparatus having two plate cylinders per one blanket cylinder, printing is being done on one plate cylinder while plate-making operations are being carried out on the other plate cylinder. In such an embodiment, the plate cylinder on which a plate is being made should be driven mechanically independently of the blanket to make the inkjet recording be made without suspending the printing apparatus. As is readily understood by analogy, this concept is applicable to the computer-to-cylinder type multi-color single- and both-side lithographic printing apparatus.

It should be noted that the hood, the digital control member and the head-protecting member can be applied to any printing apparatus described in the present specification to secure a high operability of the printing apparatus, though detailed descriptions were omitted to avoid too much repetition.

In the following, plate materials used in the invention will be described.

Metal plates comprising aluminum or chrome-plated steel are preferred. Particularly, aluminum plates having a high surface water-receptivity and wear resistance due to mechanical graining or anodic oxidation are preferred. More economical materials include those comprising a superficial image-receiving layer provided on water resistant backing including water resistant paper, plastic films or paper/plastic film laminates. A preferable range of the thickness of such materials is 100 to 300 $\mu$m whereas the image-receiving layer preferable has a thickness of 5 to 30 $\mu$m.

Preferable examples of such an image-receiving layer include hydrophilic layers comprising inorganic pigments and a binder, or those that can be rendered hydrophilic via a suitable desensitizing treatment.

Inorganic pigments used in the hydrophilic image-receiving layer include clay, silica, calcium carbonate, zinc oxide, aluminum oxide and barium sulfate. Suitable binder materials include hydrophilic compounds such as poly (vinyl alcohol), starch, carboxymethyl cellulose, hydroxyethyl cellulose, casein, gelatin, polyacrylic acid salts, poly (vinylpyrolidone), poly (methyl ether) or methyl ether-maleic anhydride copolymer. In cases where certain levels of water resistance are needed, cross-linking agents such as melamine-formaldehyde resin or urea-formaldehyde resin may be incorporated.

On the other hand, layers comprising zinc oxide dispersed in a hydrophobic binder represent image-receiving ones used with a desensitizing treatment.

Any type of zinc oxide that is commercially available as zinc white, zinc white produced by wet process or active zinc white can be used in the invention. As for zinc oxide, reference can be made to p. 319 of "Shinpan Ganryo Binran" (Pigment Handbook, a new edition) edited by Pigment Technology Association of Japan and published by Seibundo Publishing Co. in 1968.

Zinc oxide is classified, according to raw material and manufacturing process, into dry procedures including French process (indirect process) and American process (direct process), and wet procedures. Representative manufacturers include, for example, Seido Chemical Co., Sakai Chemical Co., Hakusui Chemical Co., Honjo Chemical Co., Toho Zinc Co. and Mitsui Metal Industries Co.

Resinous materials used for the binder of the image-receiving layer include vinyl choloride-vinyl acetate copolymers, styrene-butadiene copolymers, styrene-methacrylate copolymers, methacrylate copolymers, acrylate copolymers, vinyl acetate copolymers, poly(vinyl butyral), alkyd resins, epoxy resins, epoxy ester resins, polyester resins and polyurethane resins. Each of those materials may be used alone or in combination.

The content of the resin binder in the image-receiving layer preferably lies between 9/91 and 20/80 in terms of binder/zinc oxide weight % ratio.

Desensitization of zinc oxide is carried out with a desensitizing solution in an ordinary manner. Suitable desensitizing solutions include cyanide-containing ones comprising ferrocyanide or ferricyanide salts, cyanide-free ones comprising amine cobalt complexes, phytic acid and its derivatives or guanidine derivatives, those comprising inorganic or organic acids capable of chelate formation with zinc ion, or those containing water-soluble polymers.

Cyanide-containing solutions are disclosed in, for example, JP-B-44-9045 (The term "JP-B" as used herein means an "examined Japanese patent publication"), JP-B-46-39403, JP-A-52-76101, JP-A-57-107889 and JP-A-54-117201.

The back surface opposite to the image-receiving layer of the plate material should have a Beck smoothness of 150 to 700 (sec/10 mL). With such a back surface, the plate will not slip or shifts on the plate cylinder, thus enabling a highly precise printing.

Beck smoothness can be measured with a Beck smoothness tester, in which a test piece is pressed against a circular hole provided at the center of a glass plate having an extremely smooth surface at a pre-determined pressure (1 kgf/cm$^2$, 9.8 N/cm$^2$), and in which the time required for a fixed volume (10 mL) of air to pass between the glass plate and the test piece under a reduced pressure.

Preferable oleophilic ingredient contained in the inkjet ink of the invention includes hydrophobic resins or waxes having a high affinity to the ink solvent. Such hydrophobic resins may be dissolved in the ink solvent, or dispersed therein as a finely divided solid phase.

The resinous material used as the oleophilic ingredient should have a weight-averaged molecular weight (Mw) of $1.1\times10^2$ to $1\times10^6$, more preferably $5\times10^2$ to $8\times10^5$ and still more preferably $1\times10^3$ to $5\times10^5$.

Practical examples of such resinous materials include olefin polymers and copolymers such as, for example, polyethylene, polypropyrene, polyisobutyrene, ethylene-vinyl acetate copolymers, ethylene-acrylate copolymers, ethylene-methacrylate copolymers or ethylene-methacrylic acid copolymers, vinyl chloride polymers and copolymers such as poly(vinyl chloride) or vinyl chloride-vinyl acetate copolymers, vinylidene chloride copolymers, polymers and copolymers of vinyl esters of alkanoic acid, polymers and copolymers of allyl esters of alkanoic acid, polymers and copolymers of styrene or styrene derivatives such as, for example, butadiene-styrene copolymers, isoprene-styrene copolymers, styrene-methacrylate copolymers or styrene-acrylate copolymers, acrylonitrile copolymers, methacrylonitrile copolymers, alkyl vinyl ether copolymers, polymers and copolymers of acrylic acid ester, polymers and copolymers of methacrylic acid ester, polymers and copolymers of itaconic acid diester, maleic acid copolymers, acrylamide copolymers, methacrylamide copolymers, phenol resins, alkyd resins, polycarbonate resins, ketone resins, polyester resins, silicone resins, amide resins, hydroxy and carboxy group-modified polyester resins, butyral resin, poly(vinyl acetal) resins, urethane resins, rosin-based resins, hydrogenated rosin-based resins, petroleum resins, hydrogenated petroleum resins, maleic acid resins, terpene resins, hydrogenated terpene resins, coumarone-indene resins, cyclized rubber-methacrylate copolymers, cyclized rubber-acrylate copolymers, copolymers containing nitrogen-free heterocyclic rings (examples of such rings being furan, tetrahydrofuran, thiophene, dioxane, dioxofuran, lactone, benzofuran, benzothiophene and 1,3-dioxetane) and epoxy resins.

The content of the resin dispersed in the inkjet ink of the invention should preferably be 0.5 to 20% by weight based on the total ink quantity. Contents below the cited range tend to cause various problems such as a poor press life of the recorded image, while, with those exceeding the cited range, homogeneous dispersion becomes difficult or the inkjet head tends to choke, hindering a consistent ink ejection.

Use of waxy materials as the oleophilic ingredient is disclosed in the following literatures; JP-A-2-69282, JP-A-5-186723, JP-A-6-206368, U.S. Pat. Nos. 3,653,932, 3,715,219, 4,390,369, 4,484,948, 4,659,383, 4,684,956, 4,830,671, 4,889,560, 4,889,761, 4,992,304 and 5,084,099, and PCT Publication WO91/10711.

In addition to the above described oleophilic ingredient, the inkjet ink used in the present invention can contain a coloring agent that makes visual plate check easy after plate making.

As preferable examples of such coloring agents, pigments or dyestuffs that have been conventionally used in various ink formulations or liquid toners for electrophotography are included.

Inorganic or organic pigments that have been widely used in graphic arts can be applied to the present purpose, including, for example, carbon black, cadmium red, molybdenum red, chrome yellow, cadmium yellow, titanium yellow, chromium oxide, viridian, cobalt green, ultramarine blue, Prussian blue, cobalt blue, azo pigments, phthalocyanines, quinacrydones, isoindolinones, dioxazines, indanthrenes, perylenes, perynones, thioindigo pigments, quinophthalone pigments, metal complex pigments, and still other ones known in the art.

Suitable dyestuffs include azo dyes, metal complex salt dyes, naphthol dyes, anthraquinone dyes, indigo dyes, carbonium dyes, quinonimine dyes, xanthene dyes, aniline dyes, quinoline. dyes, nitro dyes, nitroso dyes, benzoquinone dyes, naphthoquinone dyes, phthalocyanine dyes and metal phthalocyanine dyes.

Each of those pigments and dyes can be used individually or in combination, in a content of 0.01 to 5% by weight of the total quantity of the ink.

The present invention will be described ingreater detail with reference to the following examples, but the invention should not be construed as being limited thereto.

EXAMPLE 1A

As the inkjet recording device, the electrostatic multichannel head described in WO93/11866 was used with a highly insulating ink comprising an insulating solvent and charged particles. The particles comprise a resin that forms a hydrophobic solid at room temperature and are dispersed in the solvent. By applying an intense electrostatic field to the ink at the ejecting point, aggregates of the charged particles are formed there, which is ejected electrostatically.

The recording head used in this example was of a 100 dpi (dot per inch), 64-channel type as shown in FIG. 7. FIG. 8 illustrates this head with ink meniscus-regulating plates 42 and 42' removed from the unit shown in FIG. 7 in order to describe the detail of the head structure. Here, a pump was used to circulate ink. An ink reservoir was arranged between the pump and ink inlet (I) for the ejecting head, and another reservoir between the ink recoverying path (O) and the ink tank. The ink was circulated by the difference of the static pressures at these reservoirs, and the ink temperature was kept at 35° C. with a heater and a thermostat under the agitation with said pump. The pump for circulation acted also as an agitating member for ink to prevent precipitation and aggregation. Further, an optical density sensor was equipped in the ink path, the output signal from which was used to order ink dilution or the addition of an undiluted ink replenisher for density maintenance.

An example of manufacturing a hydrophobic particulate resin (PL-1) to be added to the ink used for the inkjet recording device of the present invention.

Manufacturing Example 1

Manufacture of Particulate resin PL-1

A mixture composed of 10 g of a polymer dispersant (Q-1) having the following formula, 100 g of vinyl acetate and 384 g of Isopar H in nitrogen atmosphere was heated to 70° C. under stirring. The mixture was then added with 0.8 g of 2,2'-azo-bis (isovaleronitrile) (A.I.V.N.) as polymerization initiator, and allowed to react for 3 hr. In 20 min after the addition of the initiator, the mixture turned turbid and the temperature rose to 88° C. After another addition of 0.5 g of the initiator, the mixture was agitated for 2 hr at 100° C. to remove the remaining vinyl acetate. The reaction product was filtered with a 200 mesh nylon cloth after cooling to give a monodisperse, stable latex of 0.23 $\mu$m average particle diameter with a polymerization rate of 90%. The particle diameter was measured with CAPA-500, a product of Horiba Seisakusho Co., Ltd.

Polymer dispersant (Q-1)

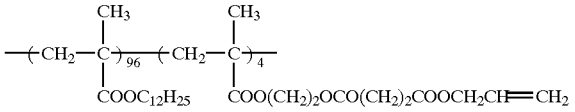

Mw = $5 \times 10^4$

Part of the latex was centrifuged at $1\times10^4$ r.p.m. for 60 min, and the resulting sediment composed of the polymer particles was collected and dried. The weight averaged molecular weight (Mw: polystyrene equivalent GPC value) of the polymer was $2\times10^5$ and its glass transition temperature was 38° C.

Preparation of Oil-based Ink (IK-1)

A fine dispersion of nigrosine was prepared by rigorously grinding 10 g of a dodecyl methacrylate/acrylic acid copolymer with a copolymerization ratio of 95/5 in terms of weight %, 10 g of nigrosine and 30 g of Shellsol 71 in a paint shaker (a product of Tokyo Seiki Co., Ltd.) together with glass beads for 4 hr.

An oil-based black ink was prepared by adding 60 g (as the solid content) of particulate resin P1-1 described in Manufacturing Example 1, 2.5 g of the nigrosine dispersion above 15 g of FOC-1400 (tetradecyl alcohol produced by Nissan Chemical Co., Ltd.) and 0.08 g of an octane-maleic acid half hexadecylamide copolymer into one liter Isopar G.

Then, the oil-based ink (IK-1) thus prepared was charged in the ink tank of the inkjet recording device of the printing apparatus (See FIG. 1 to FIG. 3.) by 2 liters. A plate material comprising an 0.12 mm thick aluminum plate the surface of which had been mechanically grained followed by anodic oxidation was loaded on the plate cylinder of the plate making apparatus by means of plate holders that catch the leading and trailing edges of the plate. The fountain solution-feeding unit, the ink-feeding unit and the blanket cylinder were separated from the plate material. After the dust present on the plate material surface was eliminated with air suction using a pump, the ejecting head was moved to the recording position close to the plate material. Based on the image data to be printed sent to the image data processing and controlling unit, the 64 channel ejecting head recorded an image on the aluminum plate with the ejected oil-based ink. During the image formation, the head was moved along with the rotation of the plate cylinder. In the recording, the end width of the ejecting electrode was set to 10 $\mu$m while the gap between the head and the plate material was adjusted to 1 mm by using an optical gap detector. To a bias voltage of 2.5 kV always applied to the ejecting electrode, a 500V pulse voltage was superimposed for ink ejection whereby the dot area was controlled by changing the voltage pulse duration from 0.2 milisec to 0.05 milisec in 256 steps. Image-recording defects or the like due to dust did not take place at all and the dot area was quite stable under a drifting external atmospheric temperature and with the increase of processed plate number.

To perform image fixing with the heat roller of the invention, the inkjet recording device was retreated from the recording position close to the plate cylinder by 50mm together with the sub-scanning member. The image fixing was carried out with a heat roller comprising a silicone rubber sealed with Teflon and containing a 300 W halogen lamp. By setting the roller temperature at 160° C., the peripheral speed of the plate cylinder at 10.6 mm/s, and the (nip) pressure to the plate cylinder at 0.55 Mpa, the plate temperature reached to 80° C. in 1 sec. A conventional lithographic printing was carried out with the plate thus fixed and coated paper. Concretely, a printing ink image was formed by feeding a printing ink and fountain solution on the plate. Then the obtained ink image was transferred onto the blanket cylinder that rotated with the plate cylinder, then the image on the blanket was again transferred onto a sheet of coated paper passing between the blanket and impression cylinders.

The resulting lithographic prints had sharp and crisp images free of void or blur even after 10,000 runs.

For 10 min after plate making, Isopar G was fed to the ejecting head from the head aperture. Then, the head was kept in a closed space filled with the vapor of Isopar G. By such an operation, the head operated perfectly for 3 months without any additional maintenance, consistently making high quality plates for printing.

Then, the dependence of the press life of the plate on the fixing conditions was investigated. Table 1A shows the dependence of the plate surface temperature on the nip pressure and the roller temperature, Table 2A the relationship between the peripheral speed and the plate temperature, Table 3A the relationship between the roller temperature and the press life, Table 4A the relationship between the nip pressure and the press life, and Table 5A the relationship between the heating temperature and the press life.

TABLE 1A

| Nip pressure | Roller temperature (° C.) | | | |
|---|---|---|---|---|
| (Mpa) | 80 | 100 | 200 | 250 |
| 0.05 | 43 | 54 | 115 | 150 |
| 0.1 | 43 | 55 | 118 | 148 |
| 0.24 | 44 | 55 | 118 | 151 |
| 0.55 | 44 | 54 | 120 | 150 |
| 1.46 | 43 | 53 | 118 | 152 |
| 20.0 | 44 | 54 | 120 | 151 |
| 25.0 | 44 | 54 | 118 | 150 |

As is shown in Table 1A, it was confirmed that about ⅓ to ⅔ of the roller temperature was transferred to the plate surface. As a preferable range of the plate surface temperature is from 40 to 150° C., the roller temperature should preferably be 80 to 250° C. Further, with the assumption that the plate surface temperature is limited to between 50 and 120° C. by taking into consideration the thermal resistance of the plate and the ink image, then the roller temperature should more preferably be 100 to 190° C. Next, the plate surface temperature is not so noticeably affected by nip pressure, but by taking into consideration the pressure and transport characteristics of the plate and the ink image, a preferable range for the nip pressure lies between 0.05 and 25 Mpa, and more preferably between 0.1 and 20 Mpa.

TABLE 2A

| Peripheral Speed (mm/sec) | 0.5 | 1.0 | 3.0 | 5.3 | 10.6 | 20.0 | 42.5 | 100 | 150 | 170 |
|---|---|---|---|---|---|---|---|---|---|---|
| Plate temperature (° C.) | 150 | 120 | 100 | 96 | 95 | 95 | 84 | 50 | 40 | 35 |

Roller temperature: 190° C.
Nip pressure: 1.46 Mpa

Table 2A indicates that the plate surface temperature is almost constant for the peripheral speed between 5 and 20 mm/sec. As a preferable range of the plate surface temperature is from 40 to 150° C., the peripheral speed should preferably be from 0.5 to 150 mm/sec. Further, with the assumption that the plate surface temperature should be limited to between 50 and 120° C., then the peripheral speed should more preferably be from 1.0 to 100 m/sec.

TABLE 3A

| Roller temperature (° C.) | 100 | 130 | 160 | 190 | Peripheral Speed (mm/sec) |
|---|---|---|---|---|---|
| Press life (prints) | 3,000 | 10,000 | 10,000 | 10,000 | 5.3 |
| Press life (prints) | 10,000 | 10,000 | 10,000 | 10,000 | 10.6 |

Nip pressure: 0.55 Mpa

Table 3A in which the dependence of press life on roller temperature is shown indicates that, for the nip pressure of 0.55 Mpa and the peripheral speed of 5.3 mm/sec, a roller temperature not lower than 130° C. is needed for a sufficient press life (10,000 runs or more), while for the nip pressure of 0.55 Mpa and the peripheral speed of 10.6 mm/sec, a roller temperature of 100° C. is enough. Accordingly, the roller temperature should be not lower than 100° C., and by taking into consideration varying peripheral speeds, should more preferably be not lower than 130° C.

TABLE 4A

| Nip pressure (Mpa) | 0.1 | 0.26 | 0.55 | 1.46 |
|---|---|---|---|---|
| Press life (prints) | 5,000 | 8,000 | 10,000 | 10,000 |

Peripheral speed: 5.3 mm/sec
Roller temperature: 160° C.

Table 4A in which the dependence of press life on nip pressure is shown indicates that, for the peripheral speed of 5.3 mm/sec and the roller temperature of 160° C., a nip pressure not lower than 0.1 Mpa is needed for a fair press life (5,000 runs or more), and a nip pressure not lower than 0.55 Mpa gave an enough durability (10,000 runs or more). Accordingly, it is concluded that the nip pressure should be not lower than 0.1 Mpa, and more preferably be not lower than 0.55 Mpa.

Further, the above-described preferable conditions should be optimally combined depending on the ink material, the heating member, the image fixing characteristics of the hydrophilic layer of the plate material and the type of the substrate.

The plate surface temperature should be set at from 40 to 150° C., and more preferably from 50 to 120° C.

From the viewpoint of preventing the heat roller from being damaged by an accidental contact with other parts, it is desirable to construct image fixing unit 5 so that a heat roller distancing/approximating member can move the roller away from the plate cylinder except when the roller is working for fixing whereby the roller is in a pressed contact with the plate cylinder.

EXAMPLE 2A

The printing part of a commercially available solid inkjet printer (Phaser 340J of Sony Techtronix Co.) was used. As in Example 1A, a plate material comprising a 0.12 mm thick aluminum plate the surface of which had been mechanically grained followed by anodic oxidation was loaded on the printing apparatus. After the dust present on the plate material surface was eliminated with air suction using a pump, the ejecting head in which wax ink was kept in a melted state was moved to a position 2 mm apart from the plate material with the help of an optical gap detecting device. Based on the image data to be printed sent to the image data processing and controlling unit, the 64 channel ejecting head, which was moved along with the rotation of the plate cylinder, recorded an image on the aluminum plate with the ejected wax ink. The image formation utilized a 600 dpi bi-level error diffusion halftoning. Image-recording defects or the like due to dust did not take place at all and the dot area was quite stable under a drifting external atmospheric temperature and with the increase of the processed plate number.

Then, the formed image was fixed in the same manner as in Example 1A (i.e., under the following fixing conditions: the temperature of the heat roller=160° C., the transport (peripheral) speed of the plate cylinder 10.6 mm/s, and the pressure of the heat roller to the plate cylinder (nip pressure)=0.55 Mpa). Lithographic printing was similarly carried out with the plate thus fixed and coated paper. Concretely, the process ink image formed on the plate was transferred onto the blanket cylinder that rotated with the plate cylinder, and the image on the blanket was again transferred onto a sheet of coated paper passing between the blanket and impression cylinders.

The resulting lithographic prints had very sharp and crisp images free of void or blur until 5,000 runs, though exhibited blurs in the highlight areas after 10,000 runs.

The head operated perfectly for 3 months without any special maintenance, consistently making high quality plates for printing.

TABLE 5A

| Heating time (sec) | 0.7 | 1.0 | 1.5 | 10.0 | 15.0 | 20.0 | Nip pres. (Mpa) | Plate temp. |
|---|---|---|---|---|---|---|---|---|
| Press life (prints) | 5,000 | 10,000 | 10,000 | 10,000 | 10,000 | 10,000 | 0.55 | 82° C. |
| Press life (prints) | — | — | — | 3,000 | 5,000 | 10,000 | — | 100° C. |

Table 5A in which the dependence of press life on heating time is shown indicates that, for the nip pressure 0.55 Mpa and the plate surface temperature of 82° C., a good press life is achieved. On the other hand, a comparative example in which a conventional heating method was adopted required 20 sec to achieve a press life of 10,000 runs. Thus, in spite of a lower plate surface temperature, the method of the invention can achieve a higher press life with a shorter heating time. These results indicate that the direct heating of plate materials with the use of a heating roller can remarkably improve heating efficiency, thus enabling compact fixing devices. Moreover, the level of fixing improves by pressing the melted image into the surface structure of the plate material and therefore the fixing time is shortened.

The above results on the dependence of press life on pressure indicates that, for the plate surface temperature of 130° C. and the peripheral speed of the plate cylinder of 10.6 mm/s, the nip pressure should be from 0.05 to 25 Mpa, and more preferably not lower than 0.5 Mpa in order to achieve a long press life.

Moreover, as for the relationship between heat roller temperature and press life, when the peripheral speed is 10.6 mm/s and the pressure of the heat roller to the plate cylinder is 0.55 Mpa, then the heat roller temperature should be from 80 to 250° C., preferably not lower than 100° C., and more preferably 130° C. or higher.

The peripheral speed of the plate cylinder of between 0.5 and 150 mm/sec was appropriate, and more preferably between 1 and 100 mm/sec.

The temperature of the plate material was ⅓ to ⅔ relative to the setting of the heat roller temperature.

In the present example, a heat roller made of silicone rubber was used. Other types of heat rollers made of fluorocarbon rubber, or made of natural rubber covered with a 400 $\mu$m thick fluorocarbon polymer film also behaved satisfactorily. Heat rollers made of still other materials can be used for the invention.

EXAMPLE 3A

As the inkjet recording device to be installed on each of the four plate cylinders of a single-side, 4 color printing apparatus (See FIG. 9), a 500 channel piezo inkjet printer XaarJet 500S made by Xaar Co. was used that was operated in a share mode. And an oil-based ink or a UV ink, both being products of Xaar Co. With a gap adjusted with a spacing roller made of Teflon, and by sending the image data to be reproduced to the image data processing and controlling unit, image formation on the aluminum plate loaded on each of the four plate cylinders was simultaneously carried out whereby the cylinder was rotated along with the movement of the 500 channel ejecting head. Such a plate making operation was repeated 500 times for each of the oil-based ink and the UV ink. The image resolution was 360 dpi and tone control was done by changing dot size in 8 levels. The image fixing processing was carried out in the same manner as in Example 1A. Image-recording defects due to dust did not take place at all and the dot area was quite stable under a drifting external atmospheric temperature. With the plate making repeated many times, dot size fluctuated a little but well within an allowance limit.

After each plate making, the ejecting head was kept in a cover after being wiped with a non-woven fabric. The head operated perfectly for 3 months without any special maintenance, consistently making high quality plates for printing.

EXAMPLE 4A

As the inkjet recording device, the piezo inkjet printing unit of a Colario PM750C of Epson Co. was employed with the oil-based ink used in Example 3A. As the plate material was used one comprising a paper substrate on which the following hydrophilic image-receiving layer was provided.

By providing both sides of a premium grade paper having a weight of 100 g/m$^2$ with a water-resistant layer comprising kaolin, poly (vinyl alcohol), a SBR latex and a melamine-formaldehyde resin, a water-resistant substrate was produced. On the resulting substrate was coated dispersion A having the following composition at a coating weight of 6 g/m$^2$ on dry base to give an image-receiving layer.

| Dispersion A: | |
|---|---|
| Gelatin (Wakc Chemical Co., first grade) | 3 g |
| Colloidal silica (Snowtex C of Nissan Chemical Co., a 20% aqueous dispersion) | 20 g |
| Silica gel (Sailicia #310 of Fuji Silicia Chemical Co.) | 7 g |
| Hardening agent | 0.4 g |
| Distilled water | 100 g |

These ingredients were blended in a paint shaker together with glass beads for 10 min.

The inkjet head was installed in a single-sided single-color printing apparatus (See FIG. 1 to FIG. 3.). The gap between the head and the plate material was adjusted with a spacing roller made of Teflon to 1.5 mm. By sending the image data to be reproduced to the image data processing and controlling unit, image formation on the plate loaded on the plate cylinders was carried out whereby the cylinder was rotated along with the movement of the ejecting head that used 32 channels for a single color. The image resolution was 720 dpi and tone control was done based on an error diffusion algorithm.

The image fixing processing was carried out in the same manner as in Example 1A.

As a result, image-recording defects due to dust did not take place at all and the dot area was quite stable under a drifting external atmospheric temperature.

The fixed plate was subjected to lithographic printing onto coated paper giving rise to lithographic prints comprising very sharp and crisp images free of void or blur over 5,000 runs. However, the image stretched by 0.1 mm for the lengthwise direction of A4 size print when the print run exceeded 5,000.

When bond paper was used instead of coated paper, voids began to occur in solid areas due to paper dust at 3,000 runs. Thus, an air suction pump was arranged near the paper-feeding unit. By this countermeasure, more than 5,000 high quality prints without void or blur were obtained. However, the image stretched by 0.1 mm for the lengthwise direction of A4 size print when the print run exceeded 5,000.

After each plate making, the head nozzles were kept in a cover after being sucked for cleaning. The head operated perfectly for 3 months without any special maintenance, consistently making high quality plates for printing.

EXAMPLE 5A

Instead of the aluminum plate used in Example 1A, a plate material having an image-receiving layer that can be converted hydrophilic via the following desensitizing treatment was used. The same operations as in Example 1A were carried out with the following exceptions. The image recording onto the whole surface of the plate material was carried out with a 600 dpi full-line head and completed with one rotation of the plate cylinder. The non-image areas of the thus prepare printing plate surface was desensitized with the desensitizing device. During image recording, an electro-conductive board spring made of phosphor bronze was kept in contact with the conductive layer of the plate material for grounding. That is, image fixing processing was carried out in the same manner as in Example 1A.

Both sides of a premium grade bond paper having a weight of 100 g/m$^2$ were laminated with a 20 $\mu$m thick polyethylene film. The resulting water-resistant substrate was coated with a conductive paint having the following composition on one side in such a manner that the coated amount be 10 g/m$^2$ after drying. On the conductive layer was provided an image-receiving layer having a coating weight of 15 g/m$^2$ on dry base by coating dispersion B.

(1) Electro-conductive Paint

Conductive paint: a mixture of the following ingredients.

| | |
|---|---|
| Carbon black (30% aqueous dispersion) | 5.4 parts |
| Clay (50% aqueous dispersion) | 54.6 parts |
| SBR latex (solid content = 50%, Tg = 25° C.) | 6 parts |
| Melamine resin (Sumilez Resin SR-613 of Sumitomo, solid content = 80%,) | 4 parts |
| Water to make the solid content equal to 25% | |

(2) Dispersion B

A mixture comprising 10 g of zinc oxide produced by dry process, 3 g of a binder resin (B-1), 17 g of another binder resin (B-2) each having the following formula, 0.15 g of benzoic acid and 155 g of toluene, prepared with a wet-type homogenizer made by Nippon Seiki Co. rotated at 6,000 rpm for 8 min.

Binder resin B-1

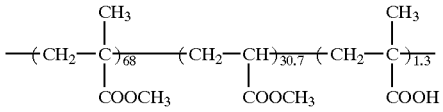

Mw = 9 × $10^3$

Binder resin B-2

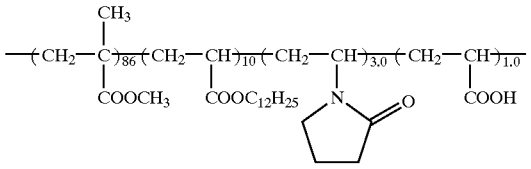

Mw = 4 × $10^4$ (The copolymerization ratios are given by weight.)

EXAMPLE 6A

The printing part of a Canon BJ35V thermal jet printer was used for recording. Ink having the following composition was prepared for recording.

| | |
|---|---|
| Acrylic resin (DEGALA NLS 50/150, a product of Degussa Co.) | 5% by weight |
| Dyestuff (Victoria Pure Blue, a product of Hodogaya Chemical) | 30% by weight |
| Methyl ethyl ketone | 55% by weight |
| Ethylene glycol monoethyl ether | 10% by weight |

As in the same manner as in Example 5A, the plate material was loaded on the plate cylinder, and after the dust present on the plate material surface was eliminated with air suction using a pump, the ejecting head in which the afore-mentioned ink was charged was brought to a position 2 mm apart from the plate material with the help of an optical gap detecting device. Based on the image data to be printed sent to the image data processing and controlling unit, the ejecting head, which was moved along the rotation of the plate cylinder, recorded an image on the plate material composed of the ink. The image formation used a 600 dpi bi-level error diffusion algorithm.

Then, the image was fixed as before and subjected to lithographic printing using printing paper. The resulting lithographic prints had very sharp and crisp images free of void or blur until 5,000 runs, though exhibited blurs in highlight areas after 10,000 runs.

After each plate making, the ejecting nozzles were sucked and wiped with a piece of non-woven fabric, and then kept in a cover. The head operated perfectly for 3 months without any special maintenance, consistently making high quality plates for printing.

According to the invention, a large number of sharp and crisp prints can be printed. And, high quality printing plates can be directly produced on the plate cylinder of a printing apparatus consistently in response to digital image data. Further, only a very short fixing time of 1 sec at 80° C. is required to achieve a sufficient level of press life. Thus, the invention can achieve a remarkable speed increase as well as a space saving in the fixing operation.

EXAMPLE 1B

Image recording was carried out in the same manner as in Example 1A, except that a lithographic printing apparatus as shown in FIGS. 10 to 12 was used. As a result, image-recording defects or the like due to dust did not take place at all and the dot area was quite stable under a drifting external atmospheric temperature and with the increase of processed plate number.

After the image formation described above, a thermal fixing of the invention was employed to enforce the image. As shown in FIG. 13, plate material 9 loaded on heat-insulating material 11*a* wrapped around plate cylinder 11 is first heated with preliminary heating member 5", and then with heat roller 5'. The preliminary heating was carried out with a near infrared lamp heater to raise the plate temperature to about 80° C. while the main fixing was done with a heat roller temperature of 80° C., the peripheral speed of the plate cylinder of 10.6 mm/sec and the (nip) pressure to the plate cylinder at 0.55 Mpa. The surface temperature of the plate material was 80° C., and the fixing time was 1 sec.

To perform image fixing with the heat roller of the invention, the inkjet recording device was retreated from the recording position close to the plate cylinder by 50 mm together with the sub-scanning member. A conventional lithographic printing was carried out with the plate thus fixed and with coated paper. Concretely, the printing ink image was formed by feeding a printing ink and fountain solution on the plate. Then the printing ink image was transferred onto the blanket cylinder that rotated with the plate cylinder, then the image on the blanket was again transferred onto a sheet of coated paper passing between the blanket and impression cylinders.

The resulting lithographic prints had sharp and crisp images free of void or blur in 10,000 runs.

In addition to near infrared lamp heaters used in the present example, other various heat emission and radiation type heaters such as lamp and ceramic ones can be used for the preliminary heating member of the invention. Further, contact conduction type heaters such as heat rollers can be used.

In the present example, a heat roller made of silicone rubber was used. Other types of heat rollers made of fluorocarbon rubber, or made of natural rubber covered with a 400 $\mu$m thick fluorocarbon polymer film also behaved satisfactorily. Rubber heat rollers made of still other materials can be used for the invention.

In the case where the image fixing was done with only heat roller 5', the roller temperature rose to 150° C. or higher, and the monomer or additives bled. But, in the method of the invention in which the preliminary heating member provided in the upstream side of the heat roller, the plate is preliminary heated and then brought into contact with the heat roller, the temperature of heat roller 5' can be made low, and thus the bleeding can effectively be suppressed.

For 10 min after plate making, Isopar G was fed to the ejecting head from the head aperture. Then, the head was kept in a closed space filled with the vapor of Isopar G. By such an operation, the head operated perfectly for 3 months without any additional maintenance, consistently making high quality plates for printing.

Table 1B, which shows the dependence of press life on plate surface temperature, indicates that the plate surface temperature of 40° C. or higher is required for a press life of 5,000 runs while the temperature of 50° C. raises the durability to 6,000, and that the temperature not lower than 80° C. can achieve a durability of 10,000 or more. Further raise-up of the plate surface temperature did not improve the durability. On the other hand, by taking into consideration the thermal resistance of the plate and the heating efficiency, the plate surface temperature should preferably not exceed 150° C., and more preferably 120° C. It was confirmed that the plate surface temperature does not strongly depend on the nip pressure, but in order to secure an ink pressing effect, the nip pressure should preferably be from 0.05 to 250 Mpa, and more preferably from 0.1 to 20 Mpa, by taking into consideration the pressure resistance of the plate material. Moreover, by taking into consideration the transfer characteristics and the thermal conductivity of the plate material, the peripheral speed should preferably be 0.5–150 mm/sec, and more preferably 1–100 mm/sec.

TABLE 1B

| | | | | |
|---|---|---|---|---|
| Plate surface temperature (° C.) | 40 | 50 | 80 | 100 |
| Press life (runs) | 5,000 | 6,000 | 10,000 | 10,000 |

Nip pressure: 0.55 Mpa
Peripheral speed: 10.6 mm/sec

Table 2B, which shows the dependence of press life on heating time, indicates that, for the nip pressure 0.55 Mpa and both of the plate surface temperature and the heat roller temperature of 80° C., a good press life is achieved in 1 sec heating time. On the other hand, a reference example in which only the heating roller was applied without preheating required to raise the heat roller temperature to 150° C. to heat the plate surface to 80° C. Further, in the case where non-contact, (radiative) heating was adopted, a sufficiently long press life (10,000 runs) was achieved with the plate surface temperature of 100° C. and 20 sec heating.

TABLE 2B

| Heating time (sec) | 0.7 | 1.0 | 1.5 | 10.0 | 15.0 | 20.0 | Nip pressure (Mpa) | Plate surface temp. (° C.) | Roller temp. (° C.) |
|---|---|---|---|---|---|---|---|---|---|
| Press life (runs) | 5,000 | 10,000 | 10,000 | 10,000 | 10,000 | 10,000 | 0.55 | 80 | 150 |
| Press life (runs) | 5,000 | 10,000 | 10,000 | 10,000 | 10,000 | 10,000 | 0.55 | 80 | 80 |
| Press life (runs) | — | — | — | 3,000 | 5,000 | 10,000 | — | 100 | — |

As direct heating with the heat roller exhibits a high heating efficiency, a good press life of 10,000 runs can be obtained with lower plate surface temperatures than those required for conventional heating methods, and thus the fixing unit becomes compact. At the same time, by pushing the molten ink into the surface structure of the plate material, the level of fixing improves, reducing fixing time noticeably.

By making use of preliminary heating, the heat roller temperature can be further lowered, extending the life of the heat roller. The bleeding of low molecular weight ingredients in the rubber material is also suppressed, preventing plate deterioration with the bled ingredients.

The heat roller as fixing unit 5 is so constructed as being separated from the plate cylinder by a heat roller distancing/approximating member. Hence, the roller is brought into contact with the plate cylinder during fixing operation, but retreated from the cylinder when it is not in operation to prevent any accidental contact with other hardwares.

EXAMPLE 2B

Printed matters were produced in the same manner as in Example 2B, except that image fixing was performed in the same manner as in Example with the same fixing conditions as in Example 1B using preliminary heating member 5" and heat roller 5'.

The resulting lithographic prints had very sharp and crisp images free of void or blur until 5,000 runs, though exhibited blurs in the highlight areas in 10,000 runs.

The head operated perfectly for 3 months without any special maintenance, consistently making high quality plates for printing.

EXAMPLE 3B

Image recording was carried out in the same manner as in Example 3A, except that fixing processing was carried out in the same manner as in Example 1B.

As a result, image-recording defects due to dust did not take place at all and the dot area was quite stable under a drifting external atmospheric temperature. With the plate making repeated many times, dot size fluctuated a little but well within an allowance limit.

After each plate making, the ejecting head was kept in a cover after being wiped with a non-woven fabric. The head operated perfectly for 3 months without any special maintenance, consistently making high quality plates for printing.

EXAMPLE 4B

Image recording was carried out in the same manner as in Example 4A, except that a single-sided single-color printer as shown in FIGS. 10 to 12 was used and fixing processing was carried out in the same manner as in Example 1B.

As a result, image-recording defects due to dust did not take place at all and the dot area was quite stable under a drifting external atmospheric temperature. The fixed plate was subjected to lithographic printing onto coated paper giving rise to lithographic prints comprising very sharp and crisp images free of void or blur over 5,000 runs. However, the image stretched by 0.1 mm for the lengthwise direction of A4 size print when the print run exceeded 5,000.

When bond paper was used instead of coated paper, voids began to occur in solid areas due to paper dust at 3,000 runs. Thus, an air suction pump was arranged near the paper-feeding unit. By this countermeasure, more than 5,000 high quality prints without void or blur were obtained. However, the image stretched by 0.1 mm for the lengthwise direction of A4 size print when the print run exceeded 5,000.

After each plate making, the head nozzles were kept in a cover after being sucked for cleaning. The head operated perfectly for 3 months without any special maintenance, consistently making high quality plates for printing.

EXAMPLE 5B

Instead of the aluminum plate used in Example 1B, a plate material as used in Example 5A was used. The same operations as in Example 1B were carried out with the following exceptions. The image recording onto the whole surface of the plate material was carried out with a 600 dpi full-line head and completed with one rotation of the plate cylinder. The non-image areas of the thus prepare printing plate surface was desensitized with the desensitizing device. During image recording, an electro-conductive board spring made of phosphor bronze was kept in contact with the conductive layer of the plate material for grounding. That is, image fixing processing was carried out in the same manner as in Example 1B.

EXAMPLE 6B

Printed matters were produced in the same manner as in Example 6A, except that fixing processing was carried out in the same manner as in Example 1B. The resulting lithographic prints had very sharp and crisp images free of void or blur until 5,000 runs, though exhibited blurs in highlight areas after 10,000 runs.

After each plate making, the ejecting nozzles were sucked and wiped with a piece of non-woven fabric, and then kept in a cover. The head operated perfectly for 3 months without any special maintenance, consistently making high quality plates for printing.

As is evident from the above description, according to the invention, the thermal image fixing after image formation is carried out by first heating with a preliminary heating member provided in the upstream side of a heat roller along the plate processing path, and then with the heat roller. By the present method, intense and lengthy heating conditions exemplified by 100° C.–20 sec needed for thermal ray emission and radiative heating using lamps or ceramic heaters are not needed. Moreover, the heat roller can be operated at a lower temperature than when used alone, leading to effective suppression of bleeding as well as speed-up of fixing operation and improved quality plate making.

While the invention has been described in detail and with reference to specific embodiments thereof, it will be apparent to one skilled in the art that various changes and modifications can be made therein without departing from the spirit and scope thereof.

What is claimed is:

1. A method of computer-to-cylinder type lithographic printing comprising:

loading a plate material on a plate cylinder of a printing apparatus;

forming an image, based on image data signal, directly onto the plate material by an inkjet image-recording process comprising ejecting an oil-based ink from a recording head;

heat-fixing the thus formed inkjet image to prepare a printing plate; and performing lithographic printing with the thus prepared printing plate, wherein said heat fixing step comprises heating with a heat roller.

2. The method of computer-to-cylinder type lithographic printing according to claim 1, wherein said heat-fixing step further comprises preliminary heating prior to said heating with the heat roller.

3. The method of computer-to-cylinder type lithographic printing according to claim 1, further comprising at least one of:

removing dust present on a surface of the plate material either or both prior to and during said inkjet image formation; and cleaning the recording head at least after the completion of said printing plate preparation.

4. A computer-to-cylinder type lithographic printing apparatus comprising:

an image-forming unit comprising an inkjet recording device which has a recording head and which forms an image directly onto a plate material loaded on a plate cylinder by ejecting an oil-based ink from the recording head based on image data signal;

heat-fixing unit which fixes the formed image to prepare a printing plate; and lithographic printing unit which carries out lithographic printing with the thus prepared printing plate having the heat-fixed image, wherein said heat fixing unit comprises a heat roller.

5. The computer-to-cylinder type lithographic printing apparatus according to claim 4, wherein said heat fixing unit further comprises a preliminary heating member disposed at an upstream portion of said heat roller.

6. The computer-to-cylinder type lithographic printing apparatus according to claim 4, further comprising a distancing/approximating member capable of distancing and approximating said heat-fixing unit with respect to the plate cylinder so that said heat-fixing unit is distant from the plate cylinder except during the fixing.

7. The computer-to-cylinder type lithographic printing apparatus according to claim 4, wherein said image forming unit further comprises a dust removing member which removes dust present on a surface of the plate surface either or both prior to and during the image formation.

8. The computer-to-cylinder type lithographic printing apparatus according to claim 4, wherein the plate cylinder is rotatable to carry out main scanning upon the image formation.

9. The computer-to-cylinder type lithographic printing apparatus according to claim 8, wherein said inkjet head comprises a single channel head or a multi channel head and movable in an axial direction of the plate cylinder to carry out sub-scanning upon the image information.

10. The computer-to-cylinder type lithographic printing apparatus according to claim 8, wherein said recording head comprises a full-line head having a width substantially equal to the width of said cylinder.

11. The computer-to-cylinder type lithographic printing apparatus according to claim 4, wherein said image-forming unit further comprises a head distancing/approximating member capable of approximating said recording head to said cylinder upon the image formation onto the plate material and of distancing said recording head from the cylinder except during the image formation.

12. The computer-to-cylinder type lithographic printing apparatus according to claim 4, wherein said image-forming unit further comprises a recording head-cleaning member which cleans said recording head at least after the completion of said printing plate preparation.

13. The computer-to-cylinder type lithographic printing apparatus according to claim 4, wherein said lithographic printing unit comprises a paper dust removing member which removes paper dust generating upon the lithographic printing.

* * * * *